United States Patent [19]

Aspelin

[11] Patent Number: 5,034,686

[45] Date of Patent: Jul. 23, 1991

[54] WEAPON INTERFACE SYSTEM EVALUATION APPARATUS AND METHOD

[75] Inventor: David J. Aspelin, Wichita, Kans.

[73] Assignee: The Boeing Company, Seattle, Wash.

[21] Appl. No.: 517,956

[22] Filed: Apr. 30, 1990

Related U.S. Application Data

[63] Continuation of Ser. No. 205,826, Jun. 13, 1988, abandoned, which is a continuation-in-part of Ser. No. 825,612, Feb. 3, 1986, abandoned.

[51] Int. Cl.[5] ..... G01R 31/02; G01R 29/02; F42C 11/00

[52] U.S. Cl. ..... 324/158 R; 89/1.59; 89/1.819; 102/206

[58] Field of Search ..... 324/158 R, 73.1; 89/1.56, 1.819, 1.813; 102/206, 200; 371/20; 364/186

[56] References Cited

U.S. PATENT DOCUMENTS

| | | | |
|---|---|---|---|
| 2,851,660 | 9/1958 | Tobin et al. | 324/73 R |
| 2,970,260 | 1/1961 | Flint | 324/73.1 |
| 3,619,792 | 11/1971 | Capeci et al. | 89/1.56 |
| 3,665,303 | 5/1972 | Richards et al. | 324/73 R |
| 3,779,129 | 12/1973 | Lauro | 89/1.56 |
| 3,803,974 | 4/1974 | Everest et al. | 89/1.56 |
| 4,300,207 | 11/1981 | Eivers et al. | 324/73.1 |
| 4,361,870 | 11/1982 | D'Agostini et al. | 73/117.2 |
| 4,494,438 | 1/1985 | Lighton et al. | 89/1.56 |
| 4,586,436 | 5/1986 | Denney et al. | 102/206 |
| 4,608,531 | 8/1986 | Stephens | 324/73 R |
| 4,623,976 | 11/1986 | Carp et al. | 364/571 |
| 4,649,821 | 3/1987 | Marshall et al. | 102/206 |
| 4,825,151 | 4/1989 | Aspelin | 324/73 R |

*Primary Examiner*—Kenneth Wieder
*Assistant Examiner*—Vinh P. Nguyen
*Attorney, Agent, or Firm*—Finnegan, Henderson, Farabow, Garrett & Dunner

[57] ABSTRACT

An apparatus and method are provided for evaluating the operational status of a weapon interface system ("WIS") for coupling an aircraft controller to a plurality of weapon systems and a corresponding plurality of weapon ejectors. The WIS to be evaluated includes a weapon system interface unit ("WSIU"), a power switching unit ("PSU"), and a power distribution box ("PDB"). The apparatus of the invention includes an input/output device removably coupled to a first WSIU port for generating a first test signal and providing the first test signal to the first WSIU port, and a processor mounted in the WIS and operatively coupled to the first WSIU port and to a selected portion of the WIS to be tested for generating a second test signal in response to the first test signal and communicating the second test signal to the selected portion to cause the selected portion to communicate a response signal to the processor corresponding to the state of the selected portion and for generating an output signal in response to and corresponding to the response signal and communicating the output signal to the input/output device.

8 Claims, 18 Drawing Sheets

WEAPON INTERFACE SYSTEM EVALUATION APPARATUS AND METHOD

This application is a continuation of application Ser. No. 07/205,826, filed June 13, 1988, now abandoned; which is a continuation-in-part of application Ser. No. 06/825,612, filed Feb. 3, 1986, now abandoned.

BACKGROUND OF THE INVENTION

1. Field of the Invention

The present invention relates to a weapon interface system evaluation apparatus and method for evaluating the operational status of a weapon interface system and, more specifically, to a weapon interface system evaluation apparatus and method for evaluating the operational status of a weapon interface system having both a self-contained remote terminal and a bus controller, such as a system complying with MIL-STD-1553.

2. Description of the Related Art

Broad interchangeability of weapon systems, e.g., missiles, is a major design goal for many modern military aircraft. For example, an aircraft that is capable of supporting both air-to-air and air-to-surface weapon systems may perform both air engagement and ground support roles. Each weapon system, however, has its own requirements for use. Various and generally unique inputs are required by each weapon type for status monitoring, targeting, arming, and ejecting the weapon system.

Military aircraft are typically designed to carry a plurality of weapon systems, some of which may be of the same design and some of which may be of a different variety. A central computer within the aircraft, referred to here as an aircraft controller, is responsive to pilot or aircrew commands and communicates with each weapon system to monitor status, perform launch preparation, and execute launch commands. These weapon systems are coupled to a tailored electronics or avionics system which responds to the aircraft controller. This avionics system serves as an interface between the aircraft controller and the weapon systems, and is referred to here as a weapon interface system ("WIS"). The WIS receives commands from the aircraft controller and translates these commands to provide data usable by one or more weapon systems. The WIS also receives power from the aircraft and distributes this power to the weapon systems. In addition, the WIS controls and provides launch power to the weapon system ejectors which eject the weapon systems from the aircraft.

A WIS, together with its wiring and ejectors, is referred to here as an unloaded weapon carriage assembly. An unloaded weapon carriage assembly joined with its weapon systems and mounted on a wing-attachable pylon or weapon bay-installable launcher, is referred to here as a loaded weapon carriage assembly. Each weapon system, e.g., an individual missile of a given type, and its corresponding ejector are referred to here as a weapon station.

The WIS typically comprises a separate electronic box, or set of cables and boxes, mounted on a pylon or launcher and physically detachable from the aircraft to facilitate interchangeability and maintainability. Accordingly, the WIS is separately storable and testable.

As noted, the aircraft may simultaneously carry a number of weapon systems of differing designs, each weapon system design having its own input requirements and providing its own outputs. In addition, the aircraft controller must be able to communicate with a selected weapon system, regardless of its design, independently of other weapon systems, so that, for example, the weapon system can provide status to the aircraft controller and the aircraft controller can specifically designate that weapon system for launch. This latter feature is important, for example, to appropriately launch the specific type of weapon system designated by the pilot or aircrew, and to systematically select the various weapon systems of a given design so that symmetric weight distribution and aerodynamic stability of the carrier aircraft can be maintained.

In the past, it has been necessary to extend cables from the aircraft controller to each WIS and from the WIS to each weapon system to provide a direct and independent communication link. This design is unattractive because it unnecessarily adds to the weight of the aircraft, generates unnecessary power and cooling requirements, and causes unnecessary electromagnetic inteference.

In response, MIL-STD-1553, entitled Military Standard—Aircraft Internal Time Division Command/Response Multiplex Data Bus, was introduced, which with its revisions and updates is incorporated herein by reference. MIL-STD-1553 replaced the multiple cable design with a dual-redundant data bus design having only two shielded twisted pair cables—a primary bus and a backup bus. The dual-redundant data bus provides a common bus for connecting the aircraft controller to each of the weapon carriage assemblies (each at its respective WIS). The aircraft controller provides a multiplexed signal over one of the dual-redundant data buses at a time to each WIS on the various weapon carriage assemblies. The WIS of each weapon carriage assembly has a remote terminal for receiving signals from and transmitting signals to the aircraft controller over the MIL-STD-1553 bus; a central processing unit ("CPU") for processing these signals, selectively interacting with the various weapon carriage assembly components, and responding to the aircraft controller; and a MIL-STD 1553 bus controller for controlling transmissions between the CPU and the weapon systems over MIL-STD 1553 weapon system buses. Firmware in the WIS, i.e., non-volatile machine language code used by the CPU, allows the WIS to determine which signals on the aircraft MIL-STD-1553 bus are directed to a given weapon system under control of that WIS.

The WIS/weapon system interface requirements for a weapon system capable of using a MIL-STD-1553 WIS are set forth in MIL-STD-1760, entitled Military Standard—Aircraft/Store Electric Interconnection System, which with its revisions and updates is incorporated herein by reference. MIL-STD-1760 weapon systems include a MIL-STD-1553 remote terminal which is designed and operates identical to the remote terminal of the WIS.

Immediately prior to deployment of a loaded weapon carriage assembly, the WIS is separately tested to verify its operational status. Upon successful completion of this test, the MIL-STD-1760 weapon systems are mated to the WIS to comprise a loaded weapon carriage assembly, as described above. The loaded weapon carriage assembly is then mated with the carrier aircraft.

Test equipment is used to perform the separate test of the WIS prior to mating it with the weapon systems. The test equipment is designed to test the operational status of the WIS to verify that all critical components are in working order and all connections are sound.

In the past, various designs have been employed for the WIS test equipment. These designs typically include active devices which simulate the operational status monitoring and command signals provided by the aircraft controller during mission performance. These test instruments, for example, provide simulated signals to the WIS and monitor its response to verify the integrity of the various internal components of the WIS. Since conventional WIS test equipment often includes active devices such as microprocessor controller chips for performing the range of test functions required to verify the operational status of the WIS, they are usually relatively complex.

The weapon system and its WIS are often stored, tested and mated with the aircraft in forward areas, i.e., in areas that may be near fronts of military conflict. These forward areas are typically remote areas where fixed buildings and reliable power sources are unavailable. However, the complex design of conventional test equipment has been such that reliable power sources and controlled environments are required for proper operation. Where these controlled conditions are unavailable, support measures such as transportable shelters are required for proper operation of the test equipment. These test equipment support measures typically require special logistics and support measures themselves, and can place an undesired burden on already taxed transportation, operational and maintenance resources during a military conflict.

Accordingly, an object of the present invention is to provide a WIS evaluation apparatus and method for quickly and reliably evaluating the operational status of a WIS.

Another object of the present invention is to provide a WIS evaluation apparatus and method for evaluating the operational status of a WIS where the WIS is in compliance with MIL-STD-1553 both for receiving data from the carrier aircraft and for communicating with MIL-STD 1760 weapon systems.

A further object of the invention is to provide a WIS evaluation apparatus and method which is operable over a wide range of environmental conditions without the need for environmental protection such as buildings or hangers.

A still further object of the invention is to provide a WIS evaluation apparatus and method which can be operated using standard power sources typically available in a field environment, such as standard aircraft power carts.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purpose of the invention as embodied and broadly described herein, a WIS evaluation apparatus and method are provided for evaluating the operational status of a WIS for coupling an aircraft controller to a plurality of weapon systems and a corresponding plurality of ejectors.

The WIS which the evaluation apparatus of the invention is intended to test has a weapon system interface unit, a power switching unit, and a power distribution box. The weapon system interface unit is coupled to the power switching unit and the power distribution box and has a first port for communicating with the aircraft controller and a second port for communicating with one of the plurality of weapon systems. The power switching unit is coupled to the weapon system interface unit and to the power distribution box and has a port for communicating with and providing power to the one of the plurality of weapon systems and a corresponding one of the plurality of ejectors. The power distribution box is coupled to an external power supply.

The WIS evaluation apparatus of the invention includes input/output means removably coupled to the first port of the weapon system interface unit for generating a first test signal and providing the first test signal to the first port of the weapon system interface unit; and processing means mounted in the weapon interface system and operatively coupled to the first port of the weapon system interface unit and to a selected portion of the weapon interface system to be tested for generating a second test signal in response to the first test signal and communicating the second test signal to the selected portion to cause the selected portion to communicate a response signal to the processing means corresponding to the state of the selected portion, and for generating an output signal in response to and corresponding to the response signal and communicating the output signal to the input/output means. The input/output means includes means responsive to the output signal for indicating the state of the selected portion.

The input/output means preferably comprises an operator interface panel having at least one selector for generating the first test signal and at least one indicator for receiving the output signal from the weapon system interface unit and indicating the state of the selected portion.

The processing means preferably includes a central processing unit mounted in the weapon system interface unit and operatively coupled to the first port of the weapon system interface unit and to the selected portion of the weapon interface system to be tested. Preferably, the processing means further includes input/output circuitry operatively coupled to the first port of the weapon system interface unit and to the central processing unit for transforming each of the first test signal and the output signal to forms and signal levels compatible with the central processing unit and the input/output means, respectively. The processing means also preferably includes simulation circuitry operatively coupled to the central processing unit and to the selected portion of the weapon interface system to be tested for selectively receiving the second test signal from the central processing unit and communicating the second test signal to the selected portion. The simulation circuitry also selectively receives the response signal from the selected portion and communicates the response signal to the central processing unit.

The WIS evaluation apparatus of the invention also preferably includes coupling means for detachably coupling the second port of the weapon system interface unit to the first port of the weapon system interface unit. The coupling means receives the second test signal from the second port of the weapon system interface unit and communicates the second test signal to the first port of the weapon system interface unit as the response signal. Coupling means may also be provided for detachably coupling the port of the power switching unit to the simulation circuitry.

Further to achieve the foregoing intentions, and in accordance with the invention as embodied and broadly described here, a method for evaluating the operational status of a WIS as described above, which may be carried out using the apparatus of the invention, is provided which includes coupling an input/output device to the first port of the weapon system interface unit; generating a first test signal and providing the first test signal to the first port of the weapon system interface unit using the input/output device; providing a processing device in the weapon interface system; generating a second test signal using the processing device in response to the first test signal and communicating the second test signal to a selected portion of the weapon interface system to cause the selected portion to communicate a response signal to the processing device corresponding to the state of the selected portion; generating an output signal using the processing device in response to and corresponding to the response signal and communicating the output signal to the input/output device; and indicating the state of the selected portion using the input/output device in response to the output signal. The method may further include coupling the second port of the weapon system interface unit to the first port of the weapon system interface unit to cause the second test signal to be communicated from the second port of the weapon to the first port of the weapon system interface unit as the response signal.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention. Of the drawings:

FIG. 2 is a block diagram of the MIL-STD-1553 remote terminal board of the weapon system interface unit shown in FIG. 1;

FIG. 3 is a block diagram of the CPU/MEM/1553 board of the weapon system interface unit shown in FIG. 1;

FIG. 4 is a block diagram of the serial controller board of the weapon system interface unit shown in FIG. 1;

FIG. 5 is a block diagram of the power command board of the weapon system interface unit shown in FIG. 1, and includes a block diagram of the weapon carriage assembly power distribution box shown in FIG. 1;

FIG. 6 is a block diagram of the power supply board of the weapon system interface shown in FIG. 1;

FIG. 7 is a block diagram of the serial slave board of the power switching unit shown in FIG. 1;

FIG. 8 is a block diagram of the PSU driver board of the power switching unit shown in FIG. 1;

FIG. 9 is a block diagram of a Preset, Verify and Execute sequencing routine performed in part by PVE circuitry on the PSU driver board of FIG. 8;

FIG. 10 is a block diagram of the relay board of the power switching unit shown in FIG. 1;

FIG. 11 is a block diagram of the PSU monitor board of the power switching unit shown in FIG. 1;

FIG. 12 is a block diagram of the weapon system bus coupler board of the power switching unit shown in FIG. 1;

FIG. 13 is a block diagram of a weapon system launch sequence which includes various external inputs, e.g., by a pilot or crew member of an aircraft, and illustrates processing performed by an aircraft controller and a WIS during a weapon system launch;

DESCRIPTION OF THE PREFERRED EMBODIMENT

Figure 1:
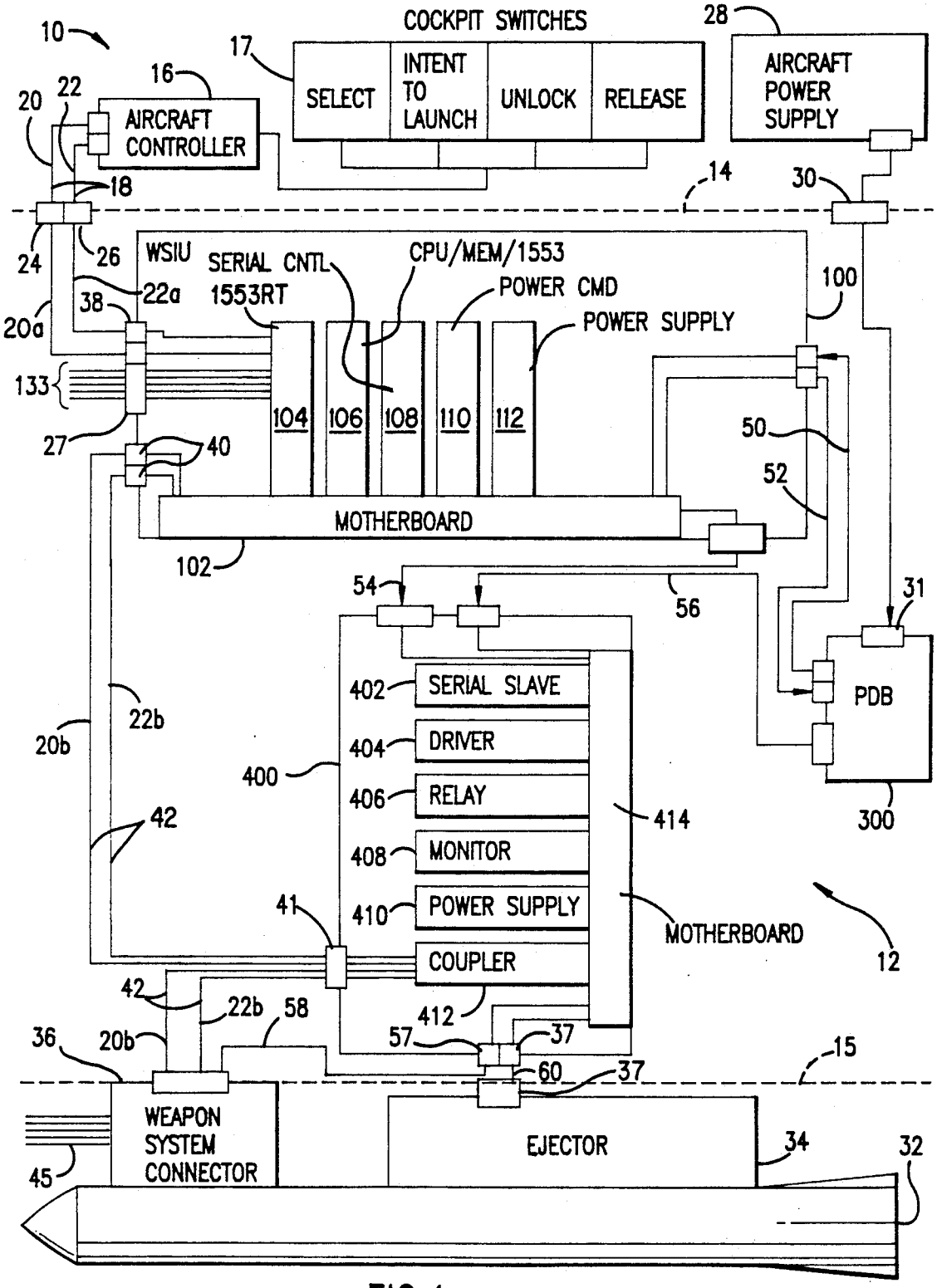
FIG. 1 shows an aircraft and a weapon system mated with a MIL-STD-1553/MIL-STD 1760 WIS of the type which the WIS evaluation apparatus of the present invention is intended to test.

Reference will now be made in detail to the presently preferred embodiment of the invention as illustrated in the accompanying drawings, wherein like reference characters designate like or corresponding parts throughout.

The invention relates to an apparatus and method for evaluating, i.e., testing, the operational status of a WIS. Therefore, appreciation of the invention is facilitated by an understanding of the design and operation of a WIS configuration which the invention is preferably intended to evaluate. Accordingly, the detailed design of a WIS is first described with reference to FIGS. 1 through 13. This is followed by a detailed description of the preferred embodiment with reference to FIGS. 14 through 19 of the invention as it relates to evaluation and testing of the WIS of FIGS. 1 through 13.

To summarize, FIG. 1 shows an example of an operational configuration of a MIL-STD-1553/MIL-STD 1760 WIS 12 of a type which the WIS evaluation apparatus and method of the present invention are intended to evaluate. WIS 12, shown between interface boundaries 14 and 15, is coupled to a military vehicle, here an aircraft 10, at interface 14, which represents an aircraft/WIS interface. WIS 12 is also coupled to a weapon system 32 at interface 15, which represents a weapon system/WIS interface. An aircraft in an operational configuration would typically have a number of these WIS devices, each coupled to a plurality of weapon systems.

As noted above, WIS 12 is typically tested as a separate unit prior to installing it on the aircraft in an operational configuration, i.e., prior to mating it with aircraft 10 and weapon system 32. As will be explained in detail below with reference to FIGS. 14 through 16, the preferred embodiment of the WIS evaluation apparatus and method of the present invention can be used to test the operational status of WIS 12 prior to mating it with aircraft 10 and weapon system 32 by slightly modifying the design of WIS 12 to include processing means for conducting testing of WIS 12, and by providing input-/output means to transfer signals to and from WIS 12 at the aircraft/WIS interface portion of WIS 12. Preferably, coupling means such as a test adapter cable are provided to couple the two major components of WIS 12, thereby providing a feedback or wrap-around feature to route signals to various portions of WIS 12.

With this background, the detailed design and operation of WIS 12 will now be described.

WEAPON INTERFACE SYSTEM DESIGN

With reference to FIG. 1, aircraft 10 is mated with WIS 12 at aircraft/WIS interface 14. Aircraft 10 includes an aircraft controller 16 for controlling aircraft electronic systems, including weapon system status monitoring and launch functions for a plurality of weapon systems. Aircraft controller 16 receives commands from the pilot or an aircrew member via cockpit switches 17 for weapon systems status- and launch-related functions. A dual-redundant data bus 18 having a primary bus 20 and a backup bus 22 in compliance with MIL-STD-1553 is coupled at one end to the output of aircraft controller 16 and at the other end to a corresponding pair of data bus couplers 24 and 26 at aircraft/WIS interface 14. Aircraft 10 also includes a conventional aircraft power supply 28 which provides AC and DC electrical power to a receptacle 30 at aircraft/-WIS interface 14, and to PDB 300 at a connector 31.

WIS 12 selectively communicates instructions and data from aircraft controller 16 to at least one weapon system 32, such as a missile. Each weapon system is mounted to an ejector 34, which typically includes a pyrotechnic device called a squib to provide the force needed to thrust the weapon system away from the aerodynamic flow field of the aircraft, for example, out the weapon bay or off the wing pylon and downward from the aircraft. WIS 12 includes a weapon system connector 36 and an ejector connector 37 for detachably coupling the WIS to weapon system 32 and ejector 34, respectively. For simplicity and ease of illustration, WIS 12 is shown coupled only to a single weapon system 32 and ejector 34 in FIG. 1. It should be noted, however, that WIS 12 is typically coupled to a plurality of weapon systems and ejectors, each referred to here as a weapon station. For example, to initiate weapon system power and operations, and to cause weapon system ejector 34 to eject weapon system 32 at the appropriate time.

WIS 12 includes a weapon system interface unit ("WSIU") 100, a weapon carriage assembly power distribution box ("PDB") 300, and a weapon/ejector command/monitor power switching unit ("PSU") 400. WSIU 100 is coupled at a first port 38 to primary bus 20 and backup bus 22 by WSIU primary bus 20*a* and WSIU backup bus 22*a*, the buses being detachably coupled at couplers 24 and 26 and being essentially part of dual-redundant data bus 18.

WSIU buses 20*a* and 22*a* are coupled by a multi-pin connector 27 to WSIU port 38. Connector 27 includes pins for each of WSIU buses 20*a* and 22*a*. In addition, connector 27 includes five pins which are selectively grounded using jumper wires to uniquely specify a five-bit remote terminal address to identify the particular WIS 12 and distinguish it from other electrical boxes or elements on dual-redundant data bus 18.

WSIU 100 is coupled at a second port 40 to weapon system connector 36 through an inductive coupler at a port 41 of PSU 400 by a dual-redundant MIL-STD 1553 weapon system data bus 42. Weapon system data bus 42 includes a primary weapon system bus 20*b* and a backup weapon system bus 22*b*. One weapon system bus 42 is coupled to weapon system connector 36 of each weapon system via inductive data bus couplers mounted on a coupler board (described below) and coupled to port 41. There will typically be a plurality of WSIU ports 40 corresponding to the plurality of weapon systems 32 supported by WIS 12. The weapon system connector 36 associated with each of WSIU ports 40 has five pins or remote terminal address straps 45 which are selectively grounded according to the design of the connector to provide a unique remote terminal address for that specific weapon system.

PDB 300 is removably coupled to and receives power from receptacle 30. WSIU 100 is coupled to and receives power from PDB 300 by a power supply line 50. WSIU 100 is also coupled to and transmits slave unit power switching commands to PDB 300 by command bus 52. WSIU 100 is coupled to PSU 400 by a command/monitor bus 54. PDB 300 is coupled to PSU 400 by a PSU power supply line 56, through which PDB 300 supplies PSU 400 with AC and DC electrical power. PSU 400 provides weapon system power and discrete signals (described below) to weapon system 32 through a port 57 coupled to weapon system connector 36 by a PSU/weapon system bus 58. PSU 400 also provides ejector commands and corresponding discrete signals to ejector 34 through PSU port 58 and over a PSU/ejector bus 60.

WSIU 100 is "slaved" (responsive) to and serves as a MIL-STD 1553 remote terminal to aircraft controller 16. Similar to an independent remote terminal in a conventional distributed data processing system, WSIU 100 receives commands from aircraft controller 16, independently processes these commands, interacts with devices slaved to it, and provides responses to aircraft controller 16. As shown in FIG. 1, WSIU 100 includes a plurality of printed circuit boards electrically connected to a motherboard 102. The plurality of circuit boards includes a MIL-STD-1553 remote terminal board 104, a CPU/MEM/1553 board 106, a serial controller board 108, a power command board 110, and a power supply board 112.

Figure 2:
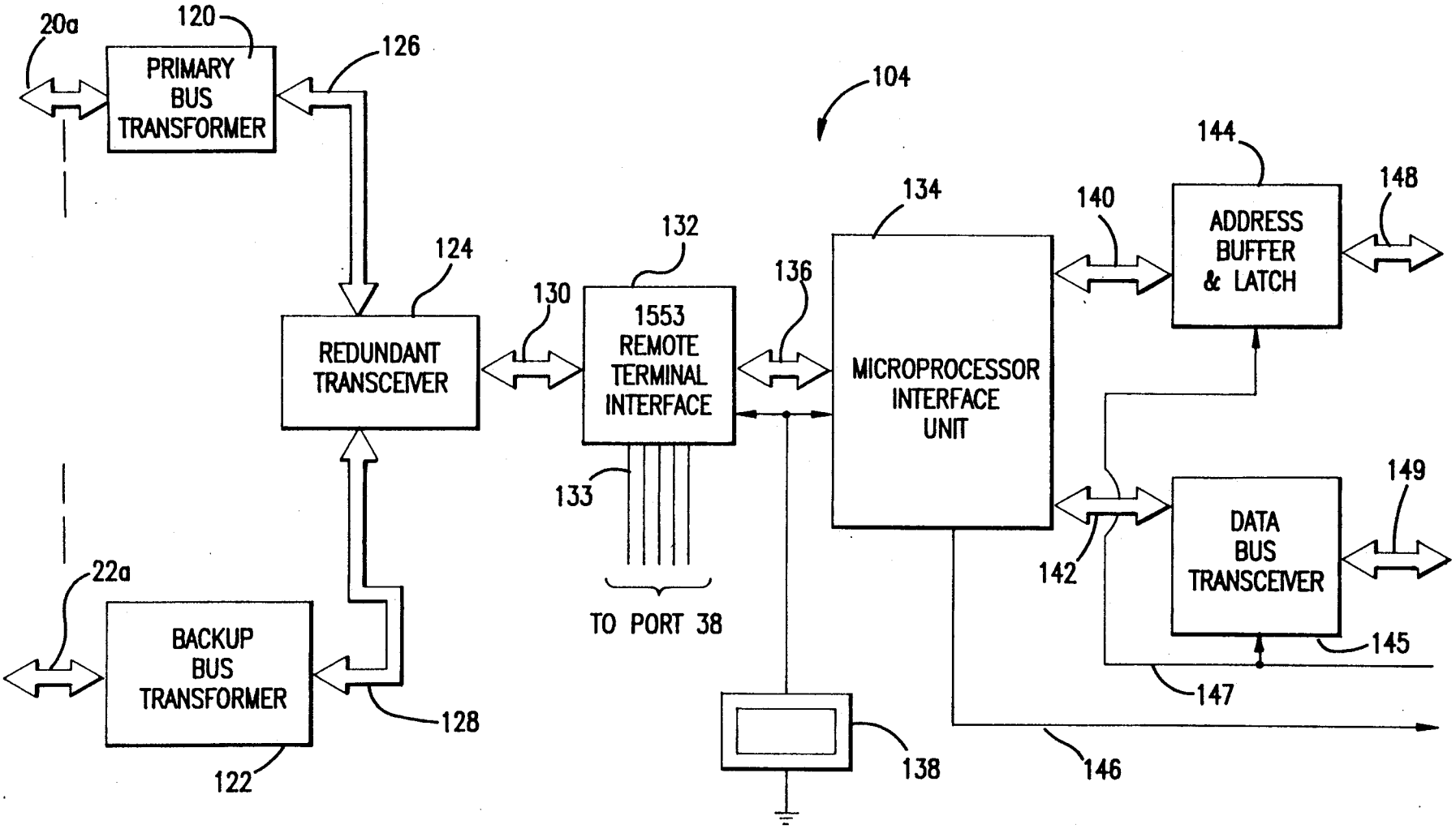
FIGS. 2 through 13 provide details of the circuit boards contained within and processing routines performed by the WIS shown in FIG. 1, specifically.

A block diagram of MIL-STD-1553 remote terminal board 104 is shown in FIG. 2. Remote terminal board 104 is coupled to WSIU primary and backup buses 20*a* and 22*a* at a primary bus transformer 120 and a backup bus transformer 122, respectively. These bus transformers electrically isolate signals on buses 20*a* and 22*a* from other components of remote terminal board 104. Bus transformers 120 and 122 are coupled to a redundant transceiver 124 by respective parallel buses 126 and 128. Redundant transceiver 124 transforms incoming signals from primary bus 20*a* or backup bus 22*a*, i.e., from aircraft controller 16, to a logic level compatible with other components of remote terminal board 104, e.g., a remote terminal interface (described below). Similarly, outgoing signals arriving at redundant transceiver 124 are applied to either bus 20*a* or 22*a* and are transmitted to aircraft controller 16. Redundant transceiver 124 applies the outgoing signals to primary bus 20a first and, if an appropriate reponse is not received, the signals are then applied to backup bus 22a.

Parallel bus 130 couples redundant transceiver 124 to a remote terminal interface 132 which encodes and decodes outgoing and incoming messages, for example, using conventional Manchester coding format. Remote terminal interface unit 132 has a plurality of remote terminal address straps 133 which are selectively grounded at connector 27 to provide a unique MIL-STD 1553 remote terminal address for that particular WIS. When the WIS is to be activated in an operational environment, aircraft controller 16 provides a 5-bit identification for that WIS over bus 20a or 22a. This address is compared in remote terminal interface 132 with the address designated by straps 133 to determine whether the signal on bus 20a or 22a is intended for that particular WIS.

Remote terminal interface unit 132 is also coupled to a microprocessor interface unit 134 via a parallel bus 136. Microprocessor interface unit 134 provides temporary buffer storage for incoming and outgoing messages and performs data error detection, e.g., parity checks. An oscillator 138 provides pulses, for example, at 12 MHz, simultaneously to remote terminal interface 132 and microprocessor interface unit 134 to synchronize data transmissions and facilitate corresponding handshaking functions. Microprocessor interface unit 134 is coupled by a pair of parallel buses 140 and 142 to an address buffer and latch 144 and a data bus transceiver 145. Redundant transceiver 124, remote terminal interface 132, and microprocessor interface unit 134 are commercially available components and, thus, details of their design are not provided here.

Microprocessor interface unit 134 includes internal CPU interrupt circuitry and a CPU interrupt line 146 for accessing the system CPU (described below) using prioritized interrupts. Address buffer and latch 144 and data bus transceiver 145 are coupled to a board select line 147 which allows circuitry from CPU/MEM/1553 board 106 to selectively enable remote terminal board 104.

CPU/MEM/1553 board 106, which is slaved to aircraft controller 16, serves as a local controller to centrally coordinate the status and operation of WIS 12. As shown in the block diagram of FIG. 3, primary components of CPU/MEM/1553 board 106 include a central processor unit ("CPU") 150, memory 152, and a MIL-STD-1553 bus controller 154. CPU 150 1s central to the operation of CPU/MEM/1553 board 106. CPU 150 performs sequencing of self-contained firmware (residing in read only memory ("ROM") contained in memory 152), responds to interrupts issued by aircraft controller 16 (via CPU interrupt line 146), and issues commands and receives responses from other circuit boards within WSIU 100 as required by commands from aircraft controller 16. CPU 150 can also be loaded with software or firmware to perform additional functions, for example, testing of various selected components of WIS 12.

In the preferred embodiment of the invention, CPU 150 is modified to perform such testing in accordance with the invention, as will be described in detail below with reference to FIGS. 14 through 19.

CPU 150 is coupled to remote terminal board 104 by WSIU address bus 148 and WSIU data bus 149 through address buffer and latch 156 and data bus transceivers 158. Memory 152 is also coupled to CPU 150 by buses 148 and 149. Board and chip select circuitry 159 is coupled to address bus 148 and has a plurality of select lines 147 for selectively enabling boards and chips designated by CPU 150. CPU 150 uses address buffer and latch 156 for temporary storage of outgoing address signals over address bus 148. CPU 150 also uses address buffer and latch 156 to access memory 152, which may be either ROM for firmware instructions or random access memory ("RAM") for data temporarily stored during the execution of a firmware routine. CPU 150 uses data bus transceivers 158 to send commands to and receive responses from circuit boards within WSIU 100 and memory locations 152 on CPU/MEM/1553 board 106.

Bus controller 154, a commercially available component, is coupled to and communicates directly with the weapon systems to provide commands and data. Bus controller 154 relays signals from CPU 150 to one or more of the weapon systems and, in addition, can initiate commands to the weapon system, such as periodic weapon system status monitoring commands. Bus controller 154 includes address buffer and latch 170 to provide temporary storage for outgoing addresses, and data bus transceivers 172 for transmitting and receiving incoming and outgoing data. Bus controller 154 also includes a microprocessor interface unit 174 coupled to each of address buffer and latch 170 and data bus transceivers 172 by respective parallel buses 176 and 178. Microprocessor interface unit 174, which performs functions similar to microprocessor interface unit 134 (FIG. 2), is coupled to a bus controller interface unit 180. Bus controller interface unit 180 performs functions similar to remote terminal interface unit 132, in addition to performing bus control functions in accordance with MIL-STD-1553. A crystal oscillator 182, which may be oscillator 138 of remote terminal board 104, provides synchronizing clock pulses to microprocessor interface unit 174 and bus controller interface unit 180. Bus controller interface unit 180 is coupled to a redundant transceiver 184 by a parallel bus 186. Redundant transceiver 184 is coupled to a primary bus transformer 188 and a backup bus transformer 190, which are coupled to primary weapon system bus 20b and backup weapon system bus 22b, respectively, at WSIU port 40.

CPU 150 is coupled to internal address buffer and latch 156, data bus transceivers 158, address buffer and latch 170, and data bus transceivers 172 over a parallel address/data bus 192.

Figure 4:
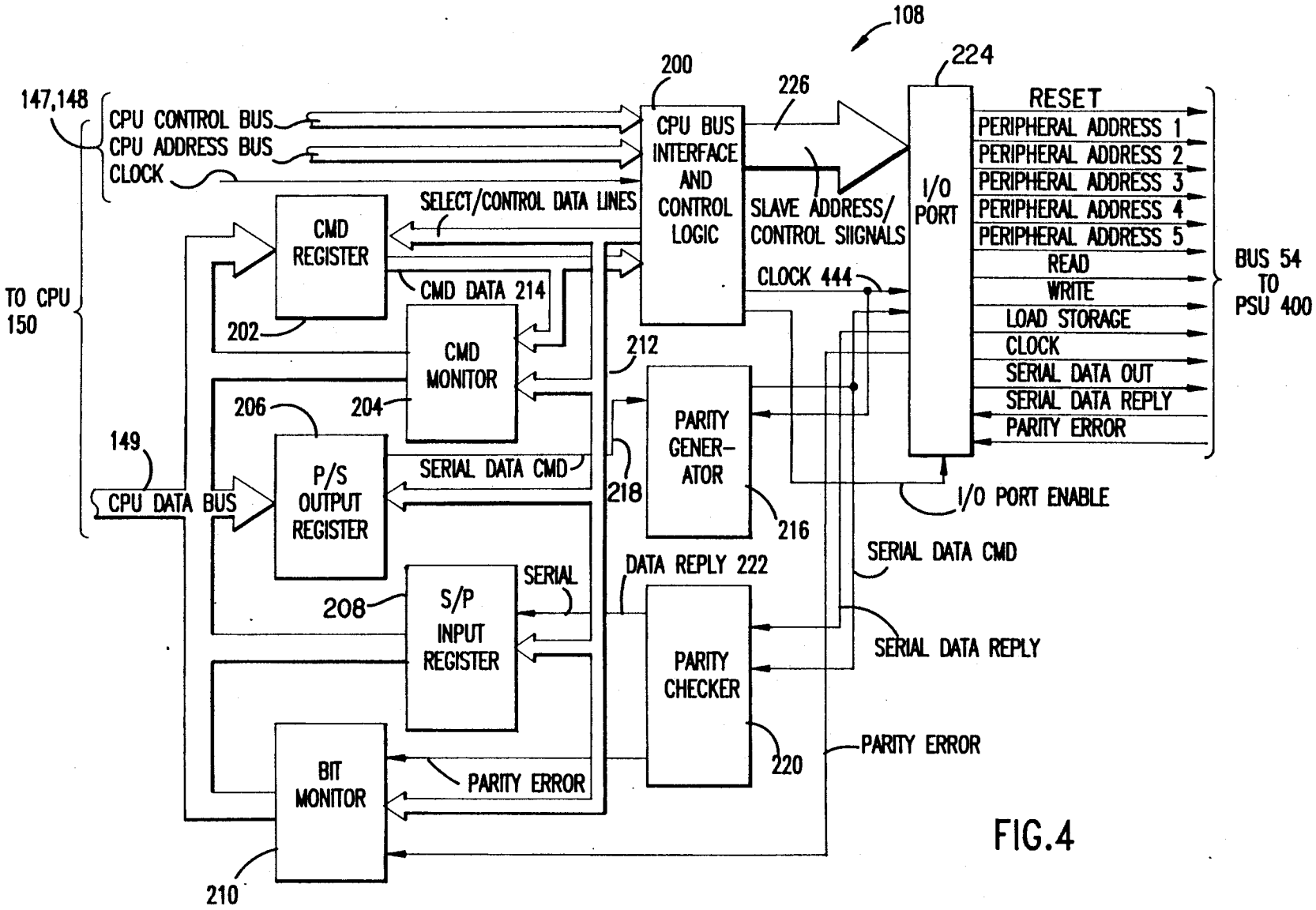

Serial controller board 108, a block diagram of which is shown in FIG. 4, provides an interface between CPU 150 of CPU/MEM/1553 board 106 and PSU 400. A principal function of serial controller board 108 is parallel-to-serial and serial-to-parallel conversion to reduce inter-box cabling and connector requirements. Serial controller board 108 also provides transmission error detection, for example, by appending one or more parity bits to the outgoing serial data and providing parity checking of both incoming and outgoing messages.

Serial controller board 108 includes a serial board controller 200 which comprises CPU bus interface and control logic coupled to WSIU address bus 148 and one of the select lines 147. Serial controller board 108 also includes a command register circuit 202, command monitor circuit 204, parallel-to-serial output register circuit 206, serial-to-parallel input register circuit 208, and built in test (BIT) monitor circuit 210, each of which is coupled to WSIU data bus 149. Each of these circuits (202 through 210) is coupled to serial board controller 200 by a select/control data bus 212. Serial board controller 200 and command monitor circuit 204 are coupled to and receive command data from command register circuit 202 through a command data bus 214.

Parity generation is provided by parity generator 216 which is coupled to the output of parallel-to-serial output register circuit 206 by serial data command line 218. Parity checking is performed by parity checker 220, which is coupled to input register 208 by serial data reply line 222.

An input/output ("I/O") port 224 provides an interface between serial controller board 108 and PSU 400, which are coupled by slave unit switching command line 52 (FIG. 1). I/O port 224 is coupled to and receives address and control signals from serial board controller 200 by slave address/control bus 226. I/O port 224 also receives clock pulses and an I/O port enable signal from serial board controller 200. In addition, I/O port 224 receives a serial data command signal from parity generator 216. I/O port 224 provides a serial data reply signal and a parity error signal from PSU 400 to parity checker 220. I/O port 224 is coupled by command-/monitor bus 54 to a serial slave board in PSU 400, shown in FIG. 7 and discussed in detail below. Command/monitor bus 54 includes a reset line, peripheral address lines 1 through 5, a read line, a write line, a load storage line, a clock line, a serial data out line, a serial data reply line, and a parity error line. Serial board controller 200 receives commands from CPU 150 and correspondingly selectively activates peripheral address lines 1 through 5, which selectively enable the various components of PSU 400.

Figure 5:
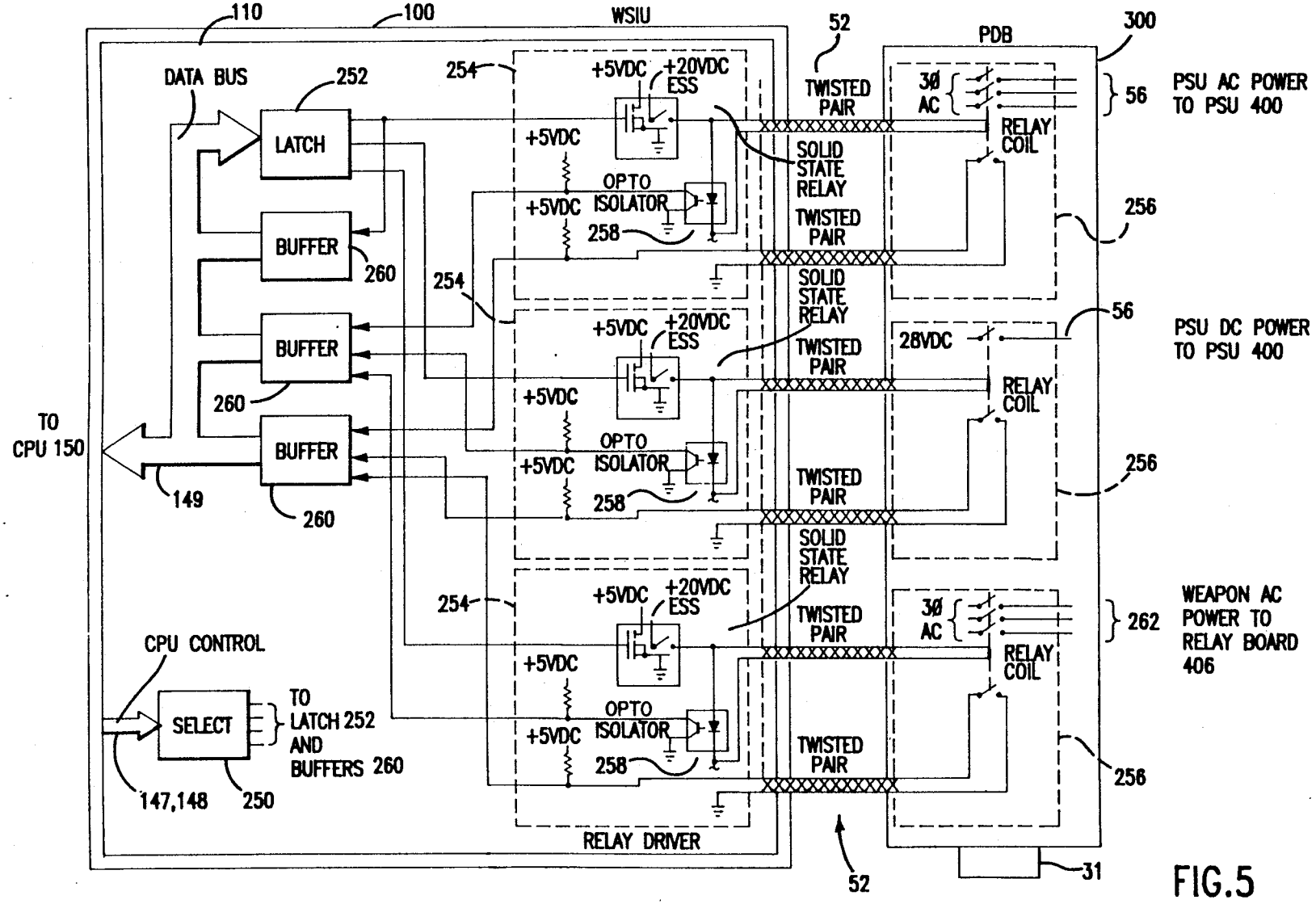

PDB 300, illustrated in FIG. 5, is coupled to and receives electrical power, e.g., three-phase 115 volt 400 Hz alternating current ("AC") and 28 volt direct current ("DC"), from an external power source such as aircraft power supply 28 or a conventional ground power cart at connector 31. Power command board 110, a block diagram of which is shown in FIG. 5, is coupled to and controls relays in PDB 300 to switch and distribute electric power to various components of PSU 400 (described below), and to the weapon systems and ejectors of the various weapon stations, in response to commands from aircraft controller 16 via CPU 150.

Power command board 110 is coupled to CPU 150 by WSIU address bus 148, WSIU data bus 149, and one of the select lines 147. The select line 147 enables power command board 110 by providing a signal to select circuitry 250. A latch 252 is coupled to data bus 149 for receiving power switching commands and selectively activating one or more of a plurality of solid state relay circuits 254. Each of the relay circuits 254 is coupled to a corresponding power relay 256 in PDB 300 by slave unit switching command line 52. Thus, activation of a relay circuit 254 controls or actuates the corresponding power relay 256 to direct power to the various components of WIS 12, weapon system 32, and ejector 34. Each of relay circuits 254 includes an electro-optic device 258 such as an opto-isolator which provides a signal to a corresponding buffer 260 to indicate the state at various points of the relay 254 and/or power relay 256. Accordingly, the status of the relays and the distribution of electrical power can be monitored at CPU 150 by selecting various ones of buffers 260 and reading relay status. The output of PDB 300 includes PSU power supply line 56 (a three-phase AC power bus and a 28 volt DC power line), a weapon AC power bus 262, and a 28 volt DC critical power bus 264 (included in line 56).

Figure 6:
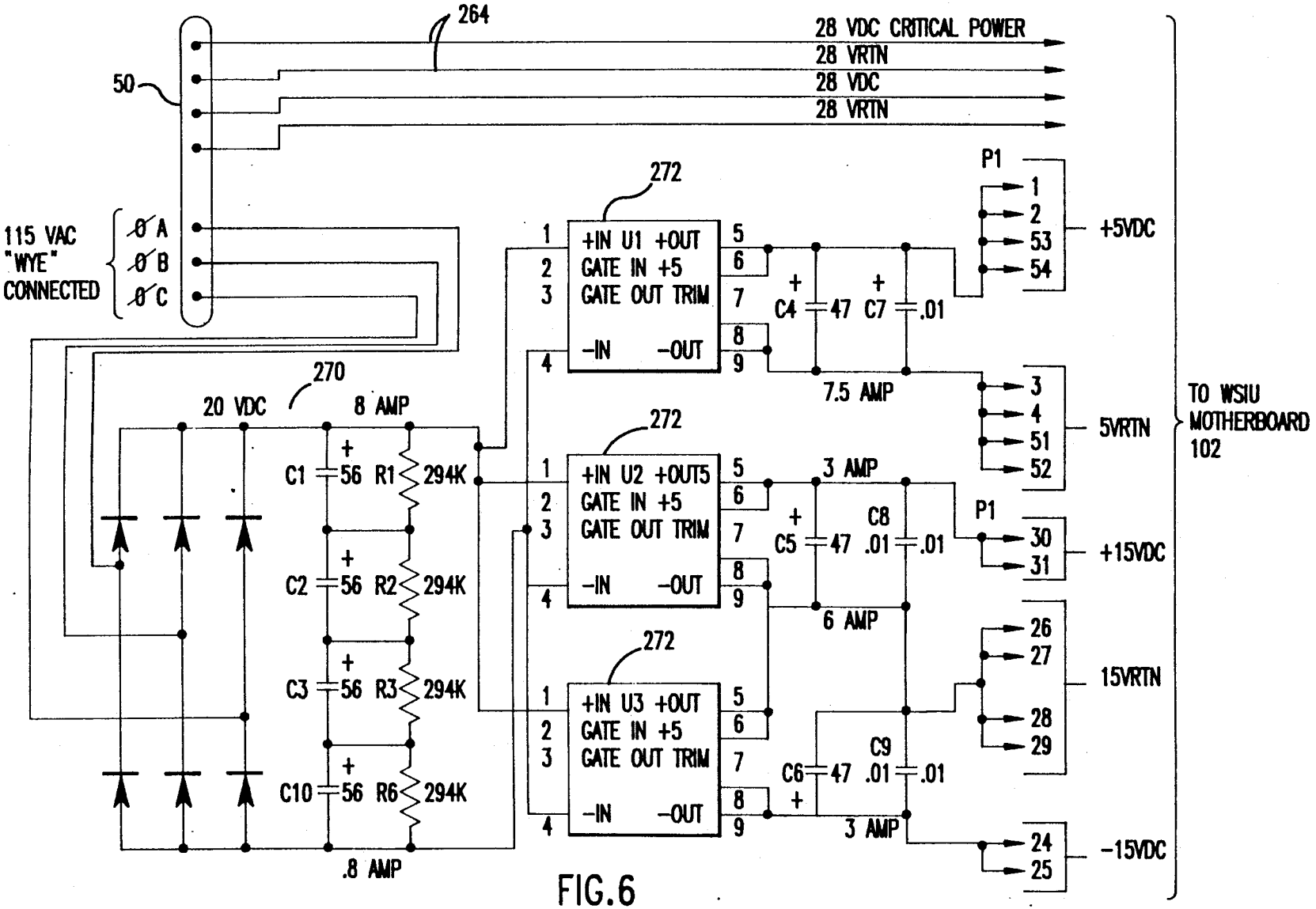

Power supply board 112, a block diagram of which is shown in FIG. 6, receives 28 volt DC and three-phase electrical power supplied from PDB power supply line 50 (FIG. 1), and regulates and distributes this power to the various circuit boards of WSIU 100 using WSIU motherboard 102. A diode network 270 converts the AC input to a full-wave rectified DC supply voltage. A DC-to-DC converting network 272 is used to convert this DC supply voltage to a series of three DC voltage levels for use by the various circuit boards of WSIU 100, preferably, +5 volt DC, +15 volt DC, and −15 volt DC. The +5 volt DC and +15 volt DC lines include return lines ("VRTN"). The 28 volt DC power is provided by a separate line and a 28 volt return line which are directly coupled to WSIU motherboard 102.

As shown in FIG. 1, PSU 400 is coupled to each of weapon weapon systems 32 and ejectors 34. PSU 400 includes a plurality of printed circuit boards for performing its power switching and monitoring functions. Included among these boards are a serial slave board 402, a driver board 404, a relay board 406, a monitor board 408, a power supply board 410, and a coupler board 412, all of which (except for coupler board 412) are electrically coupled to a motherboard 414.

Figure 7:
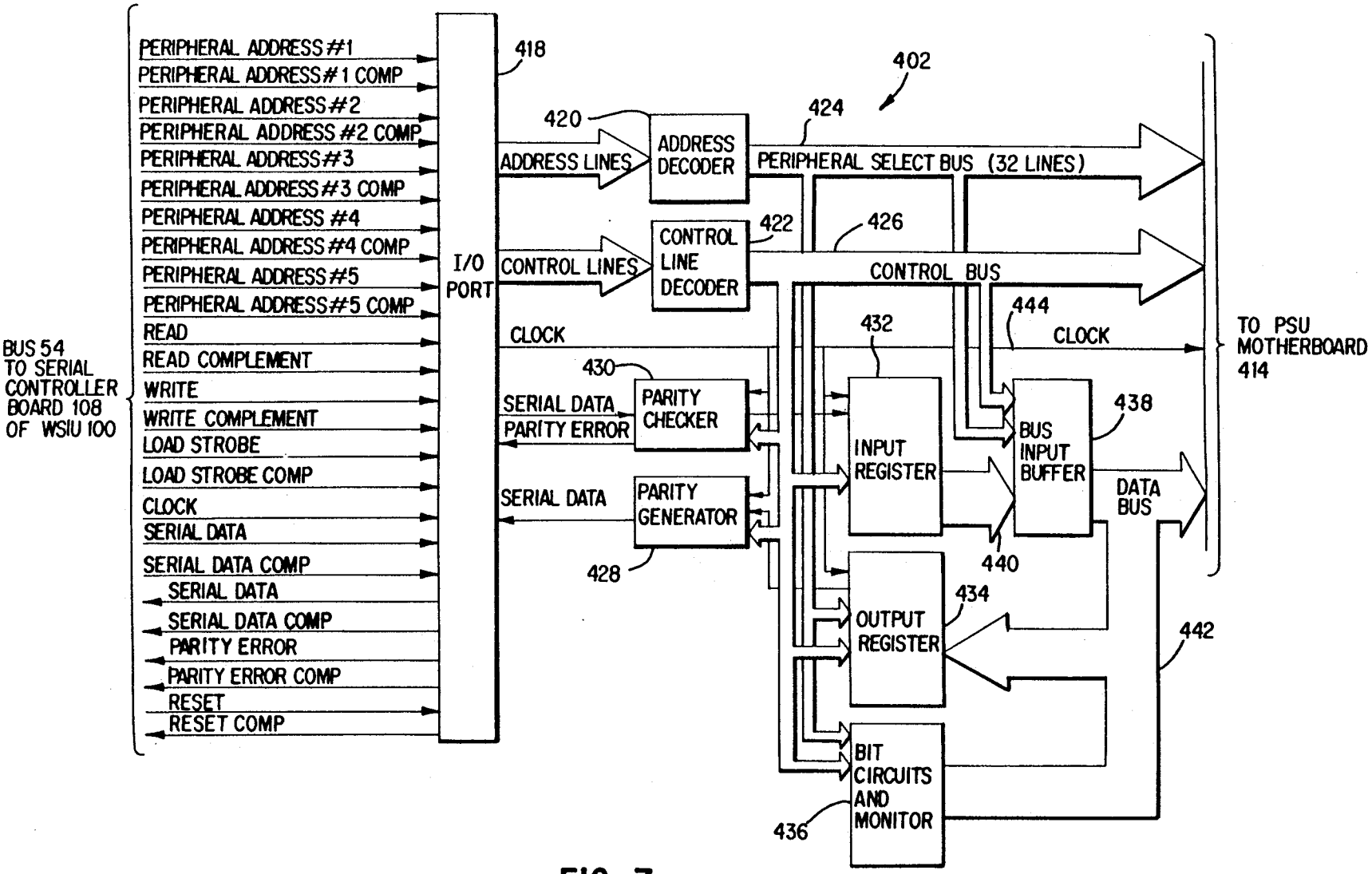

Serial slave board 402, shown in FIG. 7, is coupled to serial controller board 108 of WSIU 100 (FIG. 4) by command/monitor bus 54. Serial slave board 402 converts serial transmissions from serial controller board 108 into parallel data for internal use in PSU 400, and converts parallel data to serial format for transfer from PSU 400 to WSIU 100. Data is transferred from I/O port 224 of serial controller board 108 to an I/O port 418 of serial slave board 402. An address decoder 420 and a control line decoder 422 receive and decode address and control signals from the five peripheral address lines within line 54 and control lines I/O port 418 before providing them to a peripheral select bus 424 and a control bus 426. Serial slave board 402 includes parity generator circuitry 428 for generating parity bits on outgoing messages (to WSIU 100), and parity checker circuitry 430 for checking parity on incoming transmissions (from WSIU 100). Serial slave board 402 also includes data bus latches and buffers, i.e., PSU command input register 432, PSU status output register 434, built in test (BIT) circuits and monitor 436, and bus input buffer 438, needed to drive PSU motherboard 414 and communicate information between the other boards of PSU 400. Each of these data bus buffers is coupled to control bus 426 and, with the exception of PSU command input register 432, to peripheral select bus 424. Input register 432 is coupled to bus input buffer 438 by input bus 440. PSU status output register 434, BIT circuits and monitor 436, and bus input buffer 438 are coupled to a PSU data bus 442. Input register 432 receives serial data from serial controller board 108 via parity checker 430. The components of serial slave board 402 are clocked by a clock line 444 from serial controller board 108. The output of serial slave board 402, i.e., of peripheral select bus 424, control bus 426, PSU data bus 442, and clock line 444 are provided to PSU motherboard 414, which couples these outputs to the various boards of PSU 400. Address decoder 420 and control line decoder 422 select the other boards and PSU component functions (described below).

Figure 8:
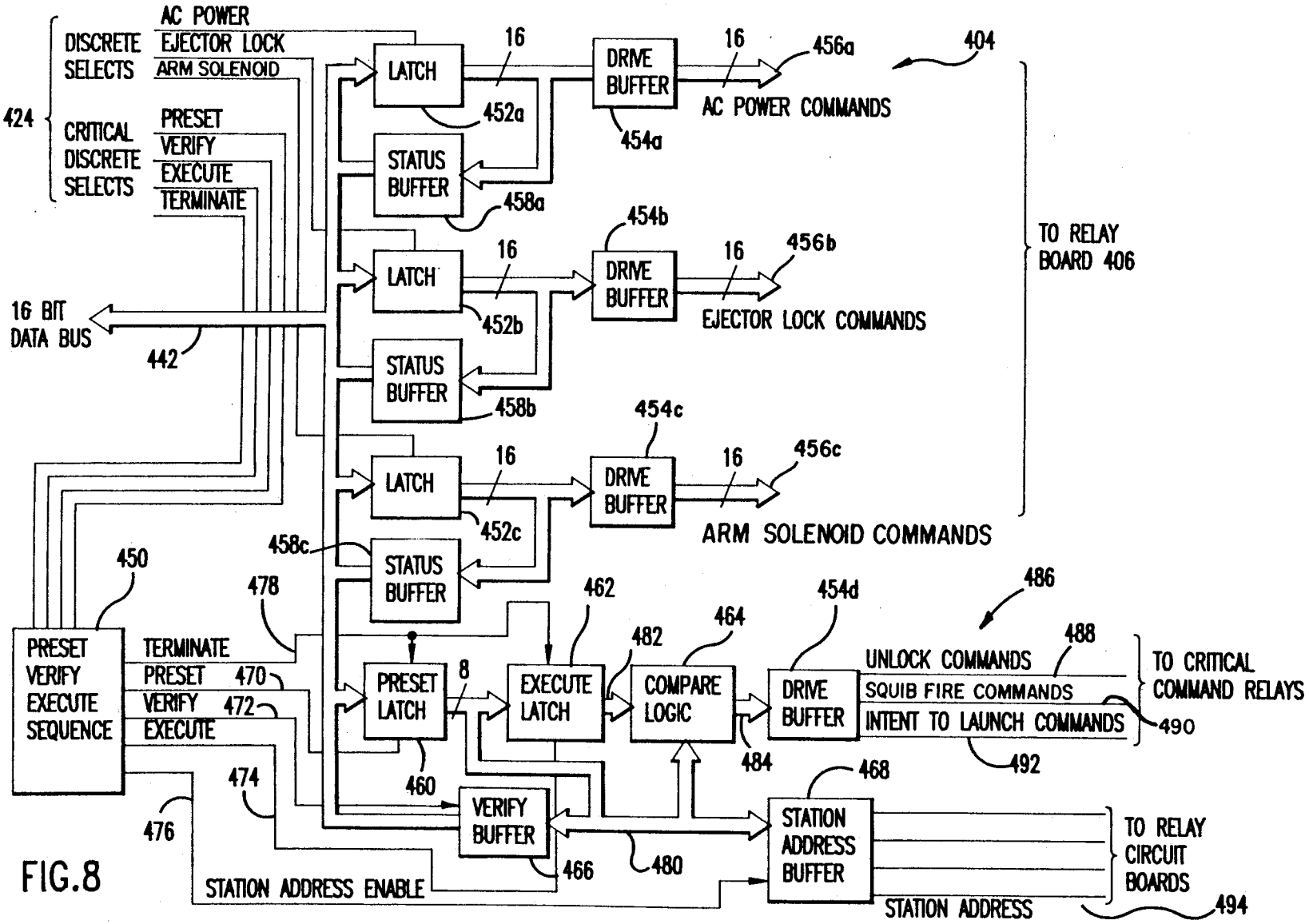
Figure 9:
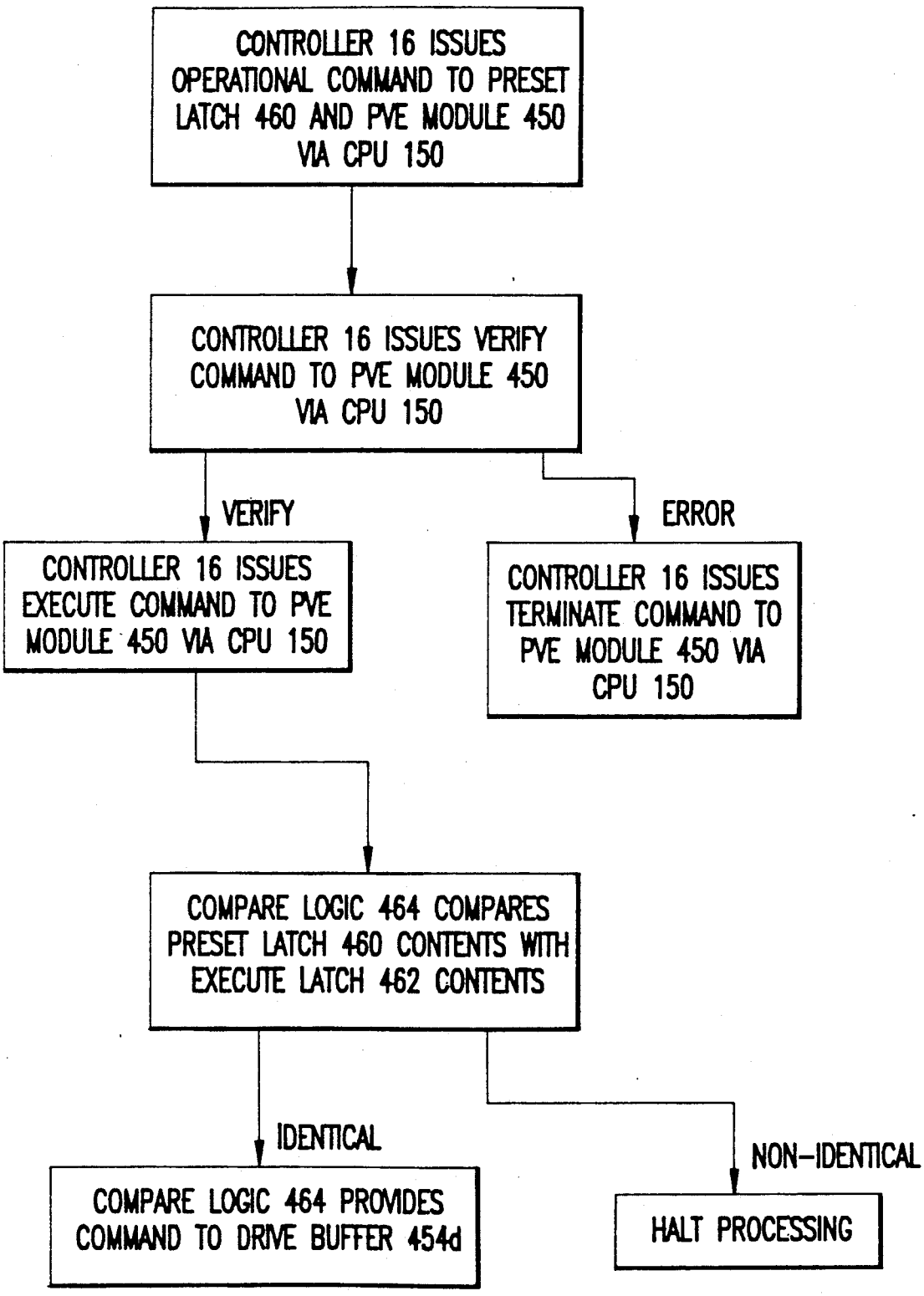

Driver board 404, a block diagram of which is shown in FIG. 8, is coupled to and responds to serial slave board 402 to activate relays that, for example, apply weapon system AC power, lock or unlock the weapon ejector 34, activate the arming solenoid that energizes the warhead in the weapon system, and sequence through critical pre-launch tasks, commonly referred to as the Preset, Verify, and Execute ("PVE") sequence, as directed by firmware in memory 152 in conjunction with a PVE sequence module 450. The PVE circuitry and sequence are used to prevent inadvertent release of a weapon. Examples of specific tasks performed in the PVE sequence include the ejector UNLOCK command, the INTENT TO LAUNCH command (required to activate the weapon system battery power source, which in turn keeps the weapon system electronics operational during the interval of time beginning when aircraft power source 28 is removed from weapon system 32, through ejection, free-fall separation from the aircraft, missile engine start, and finally power application from the engine-powered generator aboard the weapon system), and the SQUIB FIRE command.

Driver board 404 is coupled to serial slave board 402 via PSU motherboard 414 to receive discrete selects (AC weapon system power, ejector lock, arm solenoid) and critical discrete selects (ejector unlock, squib fire, and intent to launch) from peripheral select bus 424, and to receive data transmissions from data bus 442. Data transmissions are input to latches 452 corresponding to each of the discrete selects and critical discrete selects requiring input data. Each of these latches is coupled to a set of drive buffers 454, the number of drive buffers in a set corresponding to the number of weapon stations serviced by the WIS (16 indicated in FIG. 8), and the number of sets corresponding to the number of discretes and critical discretes provided to each weapon station. FIG. 8 illustrates drive buffers 454*a*, 454*b*, 454*c*, and 454*d* for the AC POWER command, ejector LOCK command, ARM SOLENOID command, and critical discretes commands, respectively. Drive buffers 454*a–c* are coupled by relay lines 456*a–c* to relay circuits on relay board 406 (described below) to selectively activate the respective weapon system and ejector discretes. Each of drive buffers 454 and latches 452 is also coupled to a corresponding status buffer 458, which is also coupled to bus 442. Status buffers 458 monitor and indicate the status of commands to relays on relay board 404 and the corresponding distribution of power in the weapon carriage assembly.

Driver board 404 includes PVE circuitry in addition to PVE sequence module 450 for performing preset, verify and execute functions as described in detail below. This PVE circuitry includes preset latch 460, execute latch 462, compare logic 464, verify buffer 466, and station address decoder 468. PVE sequence module 450 is coupled to a plurality of critical discrete selects of bus 424, e.g., preset, verify, execute, and terminate. Module 450 is also coupled via discrete control lines 470, 472, 474, and 476 to preset latch 450, verify buffer 466, execute latch 462, and station address decoder 468, respectively. In addition, module 450 is coupled via a discrete terminate line 478 to preset latch 460 and execute latch 462.

Preset latch 460 and verify buffer 466 are coupled to bus 442. Preset latch 460, execute latch 452, compare logic 464, verify buffer 466, and station address decoder 468 are coupled to one another via a bus 480. Execute latch 462 and compare logic 464 are coupled by bus 482, and compare logic 464 is coupled to drive buffer 454*b* via bus 484. Drive buffer 454*d* is coupled at its output to a critical power command bus 486, which includes an unlock command discrete 488, a squib fire command discrete 490, and an intent to launch command discrete 492. Station enable decoder 468 has as its output a plurality of station enable command discrete lines 494, one of lines 494 being coupled to the relay board circuitry for each weapon system as described below.

During weapon system launch execution, a pilot or aircrew member manually initiates a sequence of commands using cockpit switches 17. Each of these commands causes aircraft controller 16 to issue at least one corresponding operational command to WIS 12, or to weapon system 32 or ejector 34 via WIS 12, as described in detail below. The PVE circuitry provides a safety mechanism which checks the operational commands at various stages throughout the weapon system launch execution process to verify the integrity of the commands and thereby prevent inadvertent enabling or release of a weapon system. This circuitry operates in the following manner, described with reference to FIG. 9.

At various stages during weapon system launch execution processing, the pilot or aircrew member manually selects various operational commands using cockpit switches 17, e.g., SELECT, INTENT TO LAUNCH, UNLOCK, and RELEASE. Selection of each of these commands causes aircraft controller 16 to issue corresponding operational commands, e.g., SELECT, INTENT TO LAUNCH, AC POWER, ARM SOLENOID, UNLOCK and SQUIB FIRE, to CPU 150 of WIS 12. CPU 150 then issues corresponding operational commands to latches 452, preset latch 460, and PVE module 450 of driver board 404 via bus 442. As part of the command, CPU 150 may selectively activate discrete lines of peripheral select bus 424. For example, upon loading a command into preset latch 460 via bus 442, CPU 150 activates the preset discrete select of peripheral select bus 424 to enable PVE sequence module 450. The signal at preset latch 460 is applied to execute latch 462, compare logic 464, verify buffer 466, and station address decoder 468 via bus 480 upon activation of preset discrete line 470.

After the command has been applied to the appropriate buffers of driver board 404, aircraft controller 16 issues a VERIFY command to CPU 150, which translates this command and issues a corresponding command to PVE module 450. CPU 150 then activates the verify discrete select of bus 424 which causes module 450 to activate verify discrete line 472, thus enabling CPU 150 to read verify buffer 466 and verify successful loading of the command by comparing the issued command data with that read from verify buffer 466. If these values do not match and an error has thus been detected, CPU 150 communicates this information to aircraft controller 16, which responds by issuing a TERMINATE command to latches 460 and 462 via CPU 150, peripheral select bus 424, PVE module 450, and terminate select discrete line 478 to terminate further launch execution processing.

If verification is obtained, CPU 150 activates the execute discrete select of bus 424 which causes module 450 to activate execute discrete line 474 and station address enable discrete line 476. This causes the contents of execute latch 462 to be read to compare logic 464, which compares this signal with the signal obtained from preset latch 460. Agreement of these signals causes compare logic 464 to load buffer 454*d* and enable the appropriate output line from buffer 454*d*. This also causes station address decoder 468 to activate the appropriate one of the station address lines 494.

Figure 10:
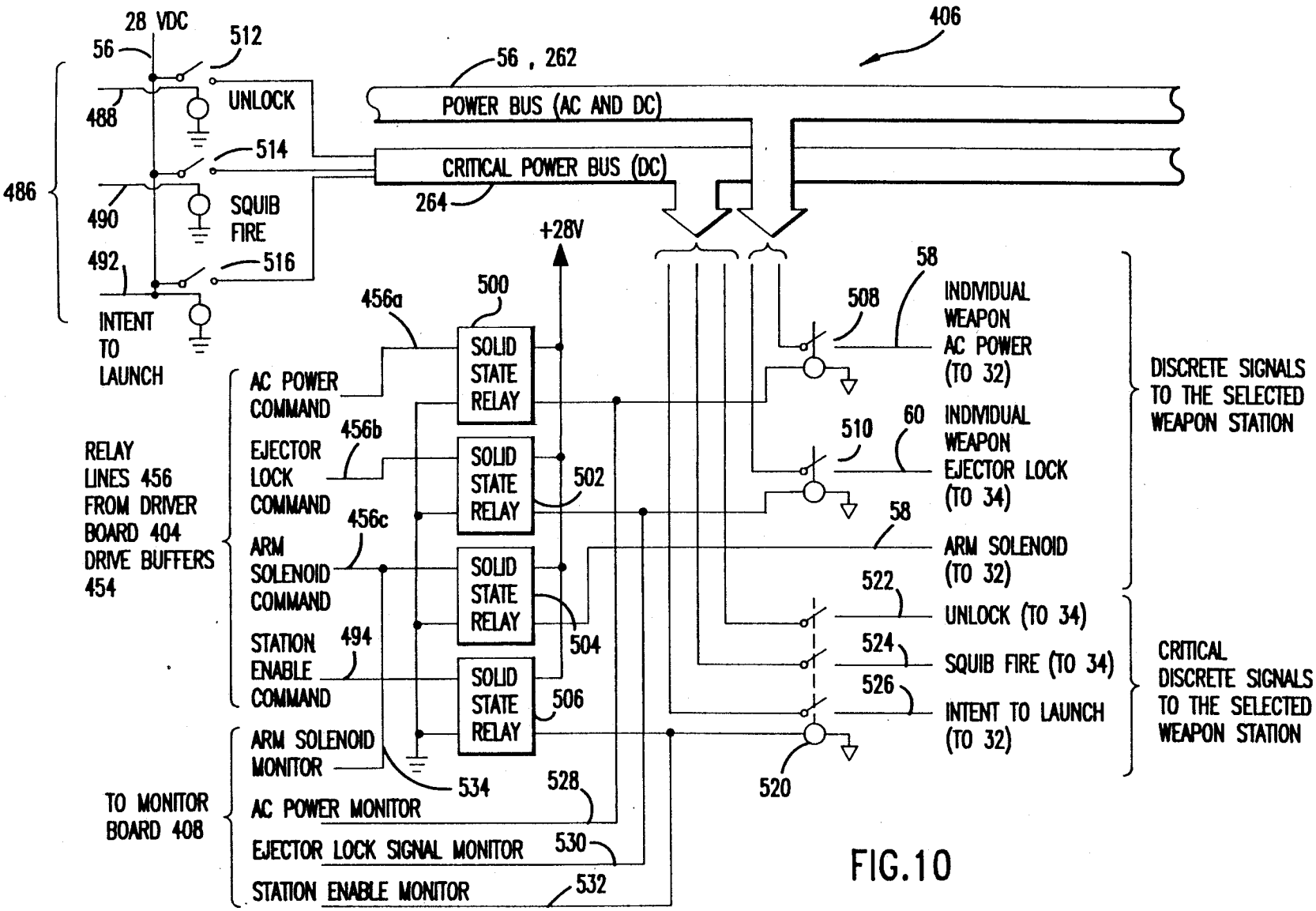
Figure 11:
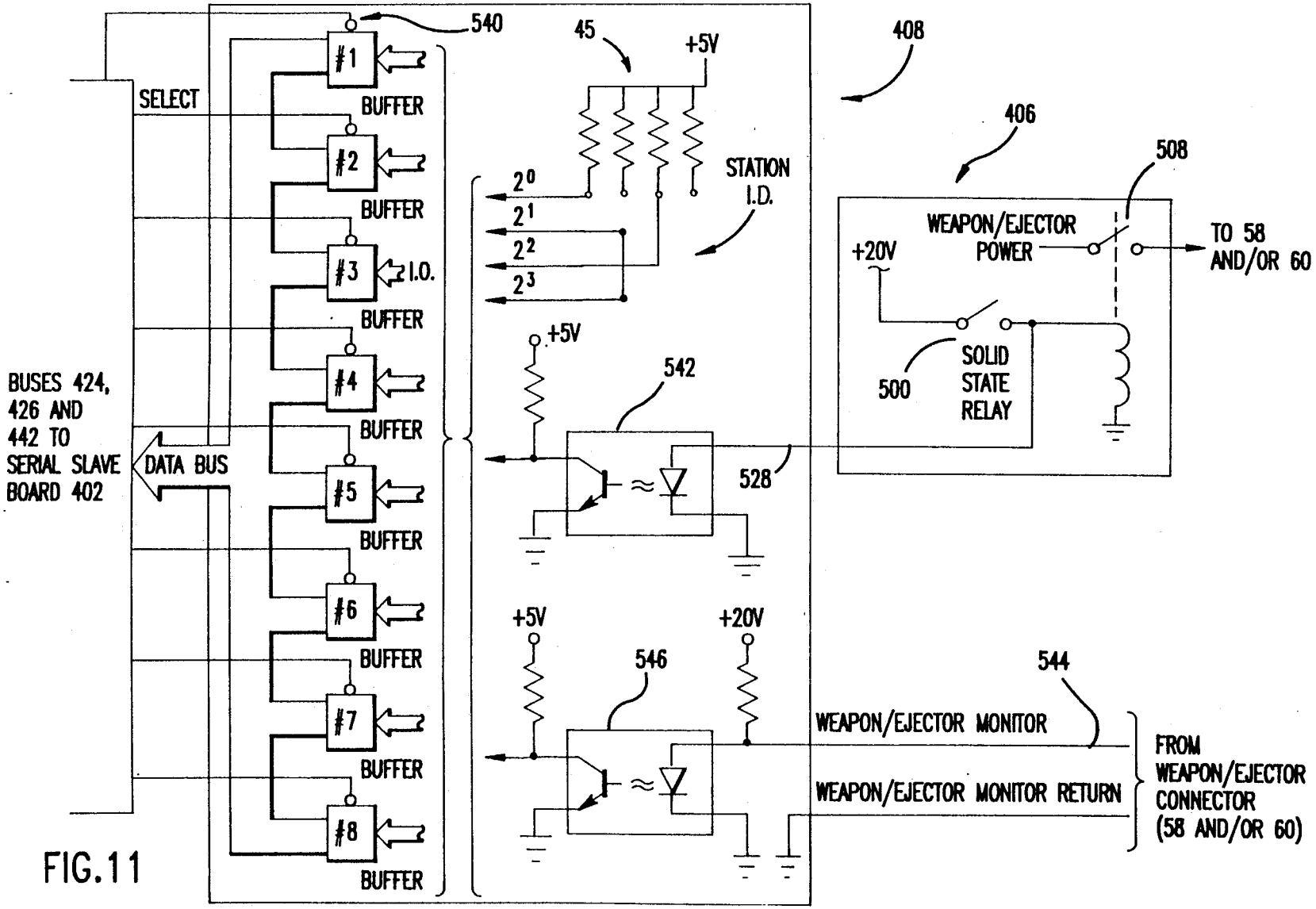

Relay board 406, a block diagram of which is shown in FIG. 10 and a portion of which is shown in FIG. 11, contains the relays commanded by driver board 404 for activating the discretes and critical discretes to each weapon system and ejector. Each of these relays is adapted to switch the quantity of power required by the respective descrete devices in the weapon system and ejector. Relay board 406 includes solid state relays 500, 502, 504 and 506 coupled to lines 456*a*, 456*b*, 456*c*, and 494, respectively. Each of relays 500, 502, 504 and 506 is also coupled to a 28 volt DC power source from the PSU power supply board. Relay board 406 also includes an AC weapon power relay 508 coupled to and closed in response to relay 500, and an ejector lock relay 510 coupled to and closed in response to relay 502. Relays 508 and 510 are also coupled to power bus 56 from PDB 300. Closure of relays 500 and 508 applies AC power to weapon system 32 via PSU/weapon system bus 58 (FIG. 1). Closure of relays 502 and 510 applies DC power to a lock on the ejector 34 via PSU/ejector bus 60 to enable unlock of the ejector. Closure of relay 504 activates the arming solenoid in weapon system 32 via PSU/weapon system bus 58.

Relay board 406 also includes relays coupled to drive buffer 454*d* for selectively controlling the application of critical power to weapon system 32 and ejector 34. These relays include an unlock relay 512, a squib fire relay 514, and an intent to launch relay 516. Relays 512, 514 and 516 are coupled to and switched by discrete lines 488, 490 and 492, respectively, of critical power command bus 486. Relays 512, 514 and 516 selectively apply 28 volt DC power from PDB 300 via PSU power supply line 56 and the PSU power supply board to critical power bus 264. Critical power bus 264 is coupled to the input of a three-pole contact relay 520. Relay 520 is coupled to and controlled by solid state relay 506, which is activated when the PVE sequence is successfully completed, as described above. The outputs of relay 520 are an ejector unlock line 522 and a squib fire line 524 to ejector 34 via bus 60, and an intent to launch line 526 via bus 58. Thus, relays 506, 512, 514, 516 and 520 selectively enable the critical discretes—ejector unlock, intent to launch, and squib fire—for the selected weapon station.

Monitoring of the various discretes and critical discretes for a given weapon station is accomplished by a plurality of monitor lines. For example, an AC power monitor line 528, an ejector lock signal monitor line 530, and a station enable monitor line 532 are coupled to the outputs of relays 500, 502 and 506, respectively. An arm solenoid monitor line 534 is coupled to the input of relay 504.

Monitor board 408, a block diagram of which is shown in FIG. 11, provides the status of the relay settings and discrete signals associated with weapon system 32 and ejector 34 to CPU 150 via serial slave board 402 and serial controller board 108. Monitor board 408 includes a plurality of station status buffers 540, each corresponding to the status of one weapon station. Monitor board 408 also includes a plurality of opto-isolators coupled at their inputs to the various monitor lines, e.g., lines 528, 530, 532 and 534 of relay board 406, and coupled at their outputs to one of buffers 540. For illustrative purposes, the partial schematic diagram of relay board 406 shown in FIG. 11 shows an opto-isolator 542 coupled to solid state relay 500 and the corresponding power relay 508 of FIG. 9 via AC power monitor line 528. Ejector 34 has a pressure switch (not shown in the figures) which is depressed when a weapon system is coupled to the ejector to indicate the presence of the weapon on a weapon present indicator line 544. An opto-isolator 546 is shown in FIG. 11 coupled to line 544. In addition, various discrete status signals are communicated from weapon system 32 and ejector 34 to opto-isolators on monitor board 408, for example, to one of opto-isolators 546 via a discrete line similar to line 544. The outputs of opto-isolators 542 and 546 are provided at one of buffers 540, e.g., buffer #1 as shown in FIG. 11. Each of buffers 540 is coupled to PSU data bus 442 and, therefore, the status of discrete signals or components for each of the weapon system/ejector pairs can be read by CPU 150.

Power supply board 410, housed on PSU motherboard 414, is identical to WSIU power supply board 112, an example of which is shown in FIG. 6. Power board 410 provides the four levels of DC power described above with regard to FIG. 6. Supply lines are provided to the input connectors of the various boards of PSU 400 through their connections with motherboard 414 to provide them with appropriate power levels.

Figure 12:
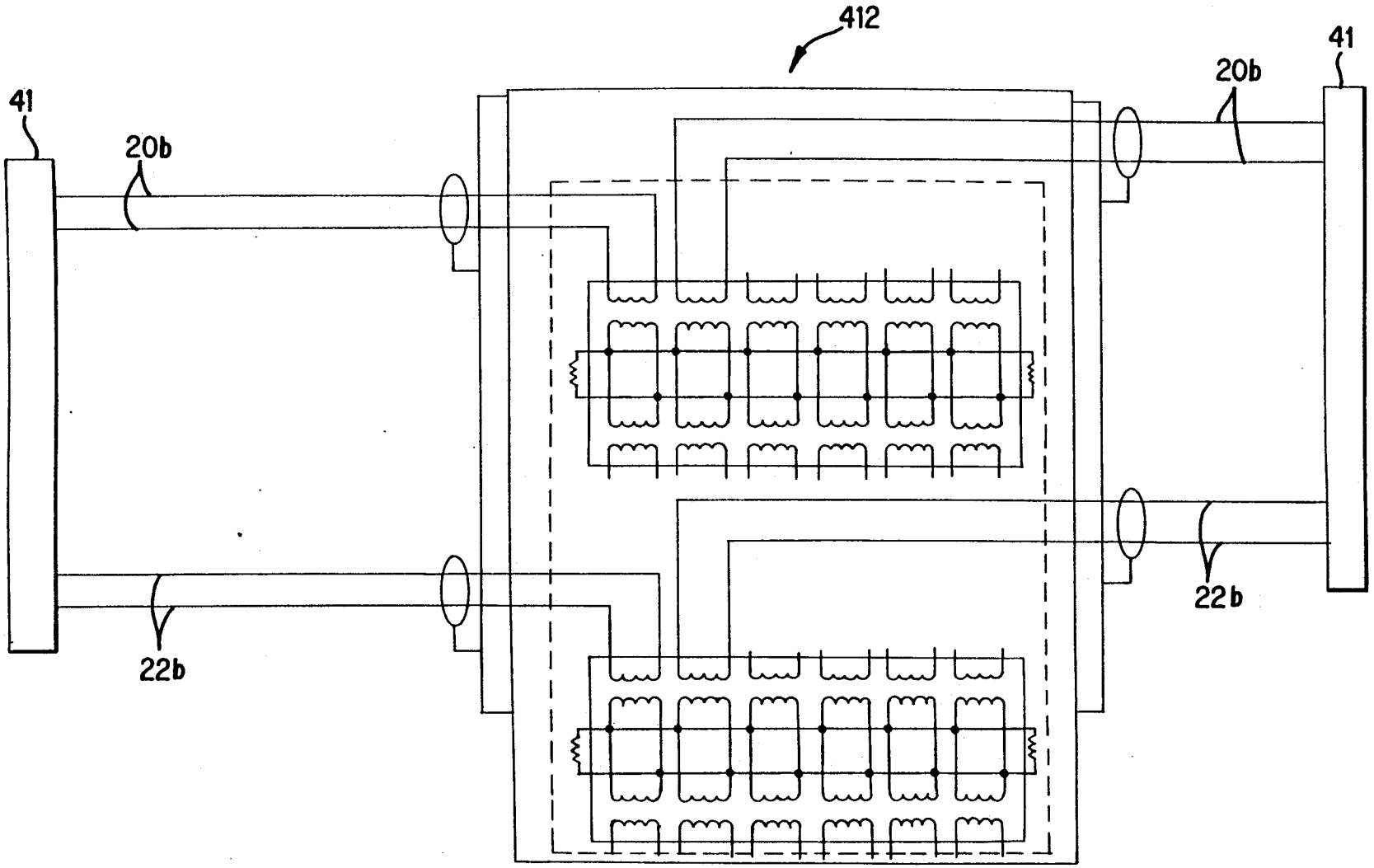

PSU 400 also includes a missile bus coupler board 412, a block diagram of which is shown in FIG. 12. Missile bus coupler board 412 provides electrical isolation required by MIL-STD-1553 for coupled remote terminals and bus controllers. Coupler board 412 is essentially an inductive coupling device for joining two portions of dual-redundant data weapon system buses 20*b* and 22*b* (FIG. 1). Coupler board 412 is not electrically coupled with other boards in PSU 400. It is included in PSU 400 in this illustrative example since such inclusion minimizes external cabling, for example, that would be required had external couplers been used. As shown in FIG. 1, coupler board 412 is coupled in series to weapon system buses 20*b* and 22*b* at port 41 of PSU 400.

WEAPON INTERFACE SYSTEM OPERATION

In a normal operational mode, the aircraft/WIS/-weapon system arrangement shown generally in FIG. 1 and described in detail above operates in the following manner. Operational functions performed on the aircraft/WIS/weapon system arrangement include status monitoring, and weapon system launch functions, e.g., weapon system data loading (e.g., targeting and fusing data), launch preparation, and launch execution.

Status monitoring involves providing the operational status of weapon system 32 to aircraft controller 16. Status monitoring may be carried out upon pilot demand and/or it may be automatically carried out on a periodic basis. Status monitoring is initiated by selection by aircraft controller 16 of a specific WIS 12 and transmission of a STATUS INTERROGATION OR STATUS command from aircraft controller 16 to port 38 of WSIU 100 via data bus 18 (FIG. 1). The STATUS command, which includes a remote terminal address identifying the WIS from which status is desired and a weapon system address which designates the specific weapon system to which the STATUS command is directed, is received at remote terminal board 104 (FIG. 2), where remote terminal interface 132 compares the address embedded in the command with the RT address designated by RT address straps 133. Upon determining that the command is directed to WIS 12, the command is checked for transmission errors, decoded, and provided to address buffer and latch 144 and data bus transceiver 145 for access by CPU 150.

The STATUS command and its address are stored in microprocessor interface unit 134 for transfer to CPU 150 via data bus transceiver 145 and address buffer and latch 144, respectively. CPU 150 periodically issues a remote terminal board select on board select line 147 which unloads data stored in microprocessor interface unit 134 through address buffer and latch 144 and data bus transceiver 145 onto WSIU address bus 148 and data bus 149, respectively, thus providing the STATUS command to address buffer and latch 156 and data bus transceivers 158 (FIG. 3) where the data is accessed by CPU 150.

Upon receipt of the status command, CPU 150 executes a status monitoring firmware sequence which causes bus controller 154 to issue a corresponding STATUS command to weapon system 32 via weapon system bus 20*b* or 22*b*. The computer and remote terminal in weapon system 32 return a status response message to bus controller 154 via bus 20*b* or 22*b*. CPU 150 reads the status response message, formats it, provides it to address buffer and latch 156 and data bus transceivers 158, and activates board and chip select 159 to designate remote terminal board 104. The status data is then transferred to remote terminal interface 132 of remote terminal board 104, from which the data are transferred to aircraft controller 16 via data bus 18 (FIG. 1).

Figure 3:
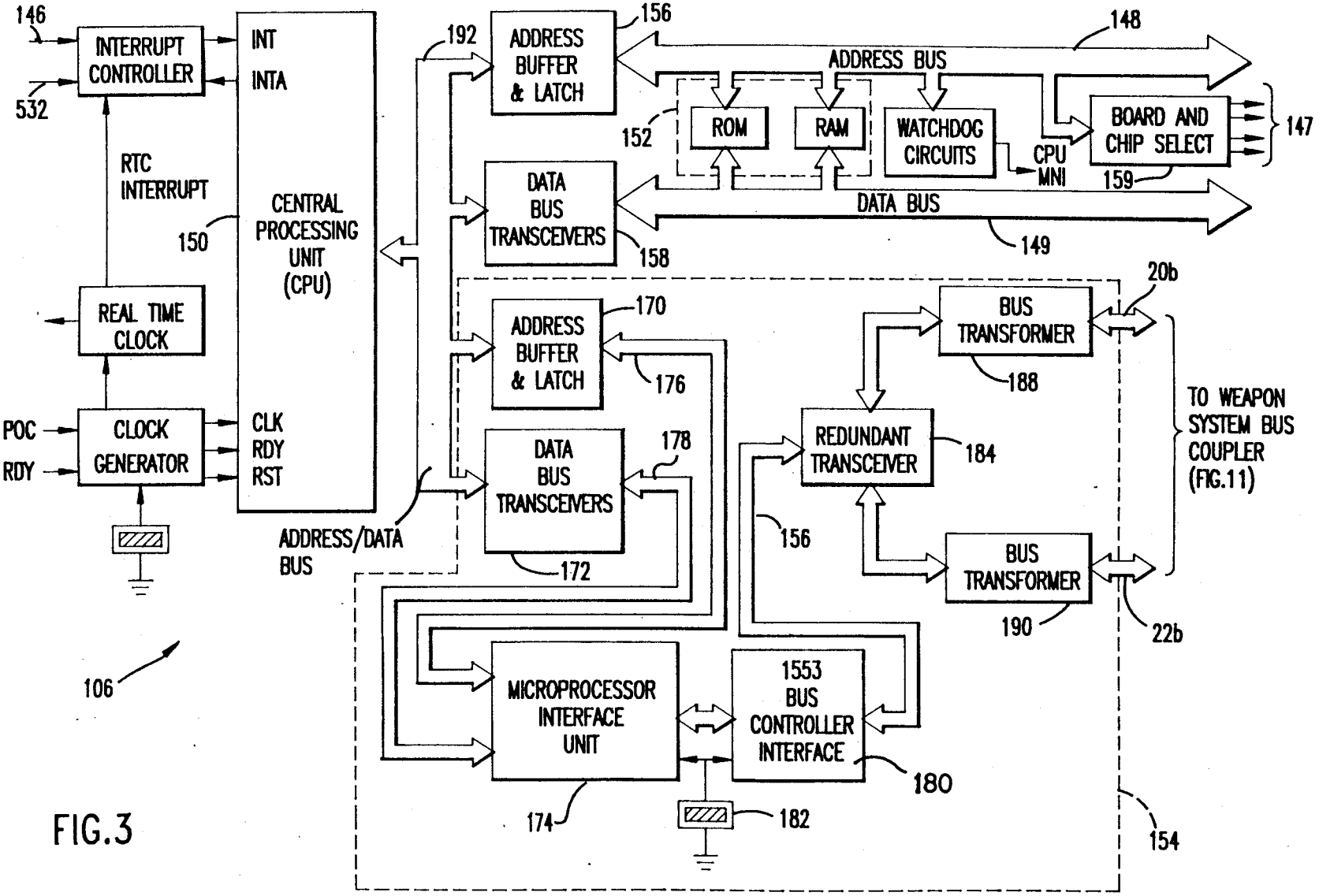
Figure 13:
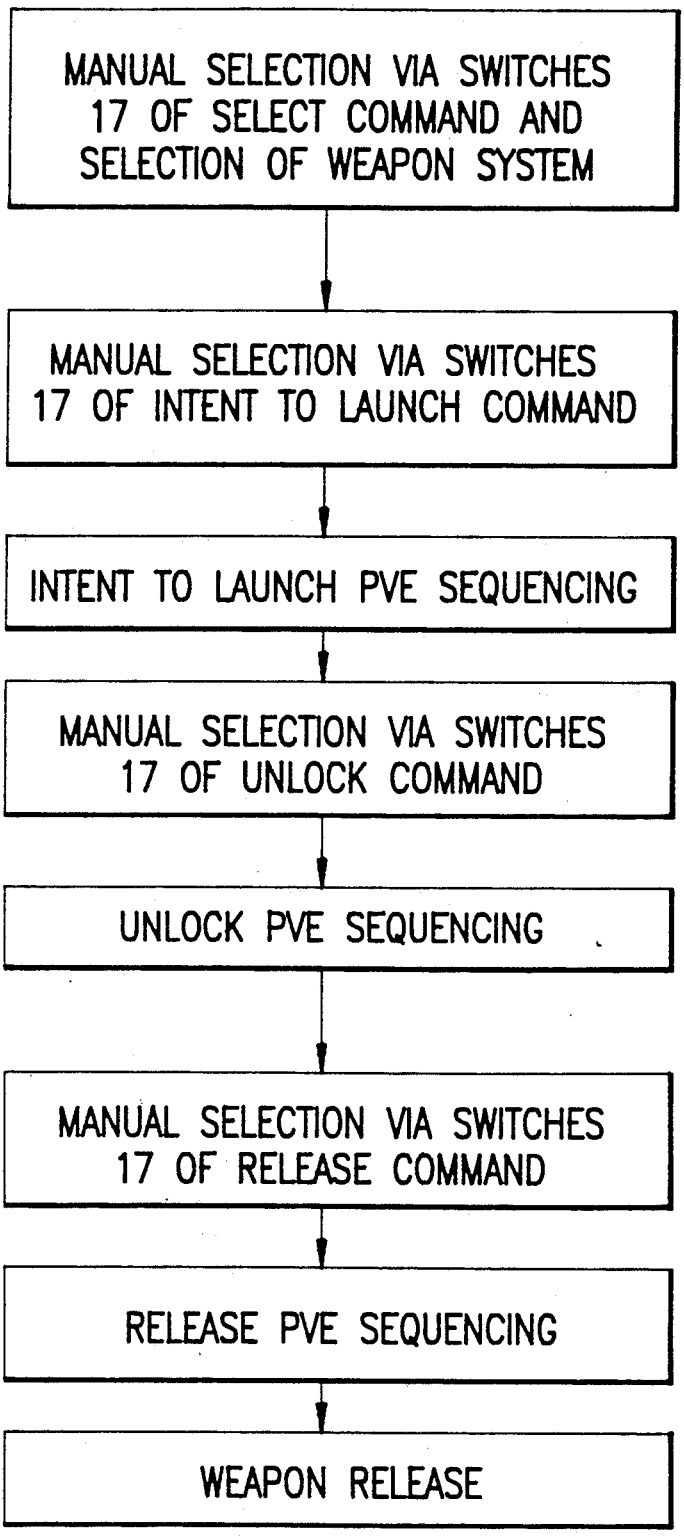

Launch execution processing occurs in the following manner, described with reference to FIG. 13. The pilot or aircrew member manually selects the SELECT switch of switch panel 17 and selects the desired weapon system. This causes aircraft controller 16 to designate a five-digit identifier which identifies the particular WIS to which associated commands are directed and to append this identifier to each of the associated commands. This identifier is compared at remote terminal interface 132 of remote terminal board 104 with predesignated address straps 133. Microprocessor interface unit 134 issues an interrupt via CPU interrupt line 146 to CPU 150, which responds by designating remote terminal board 104 using the appropriate select line 147. The SELECT command is then transferred to CPU 150 via address buffer and latch 156 and data bus transceivers 158. Upon receipt of the SELECT command, CPU 150 decodes the RT address embedded in the data load command and executes a SELECT command sequence (firmware resident in CPU 150). Instructions from the SELECT command sequence are provided to address buffer and latch 156 and data bus transceivers 158 (FIG. 3). Serial controller board 108 is then selected by the appropriate select line 147 and the signals at address buffer and latch 156 and data bus transceivers 158 are transferred through serial controller board 108 as described above and to serial slave board 402 (FIGS. 4 and 7). Serial slave board checks parity and applies the SELECT command to buses 424, 426 and 442. The SELECT command from CPU 150 is clocked to latches 452*a–c* of driver board 404, which causes correspoonding drive buffers 454*a–c* to activate relay lines 456*a–c*. Lines 456*a–c* activate solid state relays 502, 504 and 506 of relay board 406, which cause power to be applied to the selected weapon system (AC power and arm solenoid) and the corresponding ejector (ejector unlock), as shown in FIG. 10 and described above.

Also in response to the SELECT command, CPU 150 issues an instruction to bus controller 154 which causes software or firmware in microprocessor interface unit 174 to issue a STATUS INTERROGATION or STATUS command to weapon system 32. The MIL-STD 1553 remote terminal in weapon system 32 receives this command, and the computer in weapon system 32 responds to the STATUS command by providing data indicative of weapon system status. This status data is communicated to CPU 150 via bus controller 154. Upon satisfactory weapon system status response and verification, CPU 150 communicates this response to aircraft controller 16. Aircraft controller 16 then transfers targeting data to CPU 150, which in turn transmits the targeting data to the specific weapon system, i.e., to the specified remote terminal address, via bus controller 154. After loading the weapon system with targeting data, aircraft controller 16 commands CPU 150 to obtain targeting status from the selected weapon system. CPU 150 performs this task by issuing a command via bus controller 154 for weapon system 32 to report its targeting status. The computer in weapon system 32 responds to this command by communicating targeting status to CPU 150 via bus controller 154. CPU 150 communicates the targeting status response to aircraft controller 16, which displays "WEAPON READY AND TARGETED" status on a display in the cockpit.

During SELECT command processing, CPU 150 receives status monitoring signals from various components of WIS 12. For example, the status of drive buffers 454*a–c* of driver board 404 are accessible from status buffers 548*a–c*. The status of buffers 540 of monitor board 408 (FIG. 11) are also accessible to CPU 150 to provide the status of various relays and discrete signals, essentially as described above.

Upon completion of SELECT command processing, the pilot or aircrew member manually selects the INTENT TO LAUNCH switch of switch panel 17, which causes aircraft controller 16 to issue an INTENT TO LAUNCH command to CPU 150 of CPU/MEM/1553 board 106 via remote terminal board 104. CPU 150 responds by executing resident software or firmware to perform INTENT TO LAUNCH command processing. As part of the INTENT TO LAUNCH command processing, CPU 150 loads latches 454*a–c* causing solid state relays 500, 502 and 504 to close, thereby closing relays 508 and 510. This results in the application of weapon AC power and activation of the arm solenoid discrete line to weapon system 32, and activation of the ejector lock discrete to ejector 34. Also as part of the INTENT TO LAUNCH command processing, CPU 150 issues an INTENT TO LAUNCH command to preset latch 460 of driver board 404 via WSIU buses 148 and 149 and PSU bus 442. CPU 150 also initiates PVE sequence processing on the INTENT TO LAUNCH command. Thus, as described above with reference to FIG. 9, CPU 150 activates the preset select discrete of bus 424 which writes the contents of preset latch 460 to execute latch 462, compare logic 464, verify buffer 466, and station address decoder 468. Aircraft controller 16 follows the INTENT TO LAUNCH command with a VERIFY command, which causes CPU 150 to activate the verify select discrete of bus 424. PVE sequence module 450 responds by activating verify select line 472. The contents of verify buffer 466 are written to CPU 150 via bus 442. CPU 150 transfers the verify message to aircraft controller 16 via remote terminal board 104 and bus 18. Assuming the verify message received by controller 16 is proper, controller 16 issues an EXECUTE command to CPU 150, which causes CPU 150 to activate the execute select discrete of bus 424. PVE module 450 responds by activating execute select line 474, which causes execute latch 462 to be read by compare logic 464. Upon successful comparison of the signals on buses 480 and 482 by compare logic 464, the INTENT TO LAUNCH command is written to drive buffer 454*d*. Drive buffer 454*b* activates line 492 and causes solid state relay 516 of relay board 406 (FIG. 10) to close, thereby applying 28 volt DC electrical power to critical power bus 264.

PVE module 450 also responds to activation of the execute select discrete by activating station address enable line 476, which causes station address decoder 468 to enable the station enable command line 494 for the selected weapon station. Station enable command line 494 closes solid state relay 506, which in turn closes relay 520 to couple discrete lines 522, 524 and 526 to critical power bus 264. Since intent to launch relay 516 has been closed, 28 volt DC power is thereby applied as a discrete intent to launch signal to weapon system 32 via bus 58.

Upon completion of INTENT TO LAUNCH command processing, the pilot or aircrew members manually selects the UNLOCK command of switch panel 17, which causes aircraft controller 16 to issue an UNLOCK command to CPU 150 of CPU/MEM/1553 board 106 via remote terminal board 104. CPU 150 responds by executing resident software or firmware to perform UNLOCK command processing. As part of the UNLOCK command processing, CPU 150 issues an UNLOCK command to preset latch 460 of drive board 404 via WSIU buses 148 and 149 and PSU bus 442. CPU 150 also initiates PVE sequence processing on the UNLOCK command as described above. Upon successful completion of PVE sequence processing, drive buffer 454*d* activates UNLOCK discrete select line 488, which closes unlock relay 512 and causes 28 volt DC power to be applied to critical power bus 264, thereby applying this power via relay 520 to unlock discrete line 522. Activation of unlock discrete line 522 activates a solenoid in ejector 34 to unlock the ejector.

The pilot or aircrew member causes the ejector to launch the weapon by selecting the RELEASE switch of panel 17. Upon selection of the RELEASE switch, aircraft controller 16 transmits a SQUIB FIRE command to CPU 150, which causes CPU 150 to issue a corresponding SQUIB FIRE command to preset latch 460. CPU 150 then initiates PVE sequence processing as described above which, upon verification and execution, causes drive buffer 454*d* to enable squib fire command discrete line 490. This in turn closes squib fire relay 514 which, since switch 520 has been closed, applies 28 volt DC critical power to squib fire line 524. This results in ignition of the squib, which propels the weapon system away from the ejector and aircraft.

Having described the design and operation of a MIL-STD-1553 WIS, the preferred WIS evaluation apparatus and method of the invention will now be described.

WEAPON INTERFACE SYSTEM EVALUATION APPARATUS

As with earlier designs of WIS evaluation devices, the WIS evaluation apparatus of the invention uses a form of simulation to test the WIS in which operational or pseudo-operational signals are used to stimulate various components and sections in the WIS, and resultant responses are measured. In contrast with such earlier designs, however, the WIS evaluation apparatus of the invention performs testing in a highly efficient manner and with significantly reduced hardware and environmental constraints, in part by utilizing hardware already within the WIS to assist in generating the operational or pseudo-operational commands and in measuring responses. For example, CPU 150 is ideally suited for performing such processing and can be adapted to include or access computer programs stored in ROM or RAM for conducting tests and compiling response data for various portions of the WIS under test. Thus, software or firmware in or accessible to CPU 150, e.g., in memory 152 of CPU/MEM/1553 board 106 (FIG. 3), can cause CPU 150 to selectively issue commands essentially as described above with regard to the normal operation of the WIS to collect response data from the various preexisting monitoring circuits inherent to the WIS and from output lines of the WIS, and communicate stimulus/response results back to an input port of the WIS, e.g., WSIU port 38, essentially as the WIS reports weapon system status or PVE sequence verification under normal operating conditions as described above. This allows the active components of the WIS evaluation apparatus such as CPU 150 to be sealed within the WIS and thus be protected from adverse environmental conditions.

Figure 14:
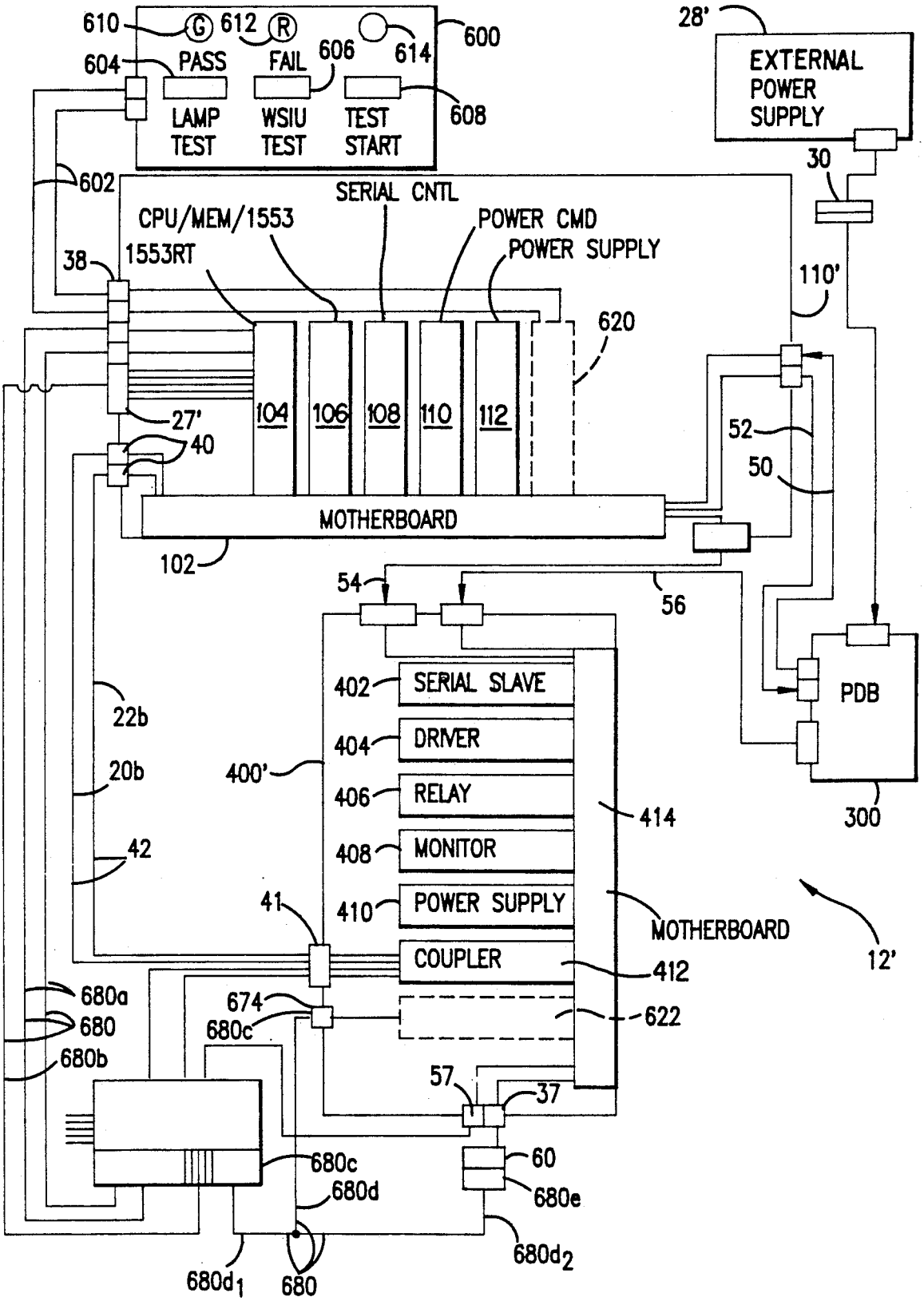
FIG. 14 illustrates the preferred embodiment of the WIS evaluation apparatus of the invention.

A presently preferred embodiment of the WIS evaluation apparatus coupled to and incorporated into a WIS 12' in accordance with the invention is shown in FIG. 14. WSIU 100' and PSU 400' are essentially the same as WSIU 100 and PSU 400 of FIG. 1 but they have been modified slightly to facilitate testing in accordance with the invention as described in detail below. WIS 12' is somewhat modified relative to the WIS 12 of FIG. 1, as described in detail below. The WIS evaluation apparatus of the preferred embodiment is adapted to test a WIS such as WIS 12' prior to mating the WIS with a weapon system and an aircraft.

The preferred apparatus of the invention includes input/output means removably coupled to port 38 of WSIU 100' for generating a first test signal to initiate testing, and for providing the first test signal to remote terminal board 104 which is coupled to port 38. The first test signal will be described more fully below, but generally comprises one or more signals or commands to CPU 150 to initiate prestored test firmware routines.

The input/output means of this embodiment includes an operator interface panel 600 coupled to WSIU port 38 by a detachable panel coupling line 602. Panel 600 preferably includes three selector buttons—lamp test 604, WSIU self test 606, and test start 608—and three indicators—a test pass indicator 610, a test fail indicator 612, and a test cable connection verification indicator 614. Each of the three selector buttons is activated by depressing a respective pressure-sensitive, spring-loaded panel selector button.

Panel 600 includes conventional circuitry for conducting a lamp test of the panel indicators in response to selection of lamp test selector button 604. Panel 600 also includes circuitry coupled to each of selector buttons 606 and 608 for outputting an appropriate form of the first test signal in response to selection of one of selector buttons 606 and 608. The circuitry for generating the first test signal may take a variety of forms. For example, it may include discrete lines, one for each of selectors 606 and 608, which are provided to coupling line 602 in a conventional manner. In this case, coupling line 602 would include a plurality of discrete lines. Alternatively, the circuitry for generating the first test signal may include one or more buffer registers which are loaded in response to selection of one of selectors 606 or 608, and which are read by CPU 150 over coupling line 602.

Coupling line 602 is adapted to detachably couple I/0 panel 600 to the connector at WSIU 100' so that the first test signal can be communicated from I/O panel 600 to WSIU 100' and an output signal can be communicated back from CPU 150 to I/O panel 600. Since the specific circuitry in panel 600 for generating the first test signal in response to selector buttons 606 and 606 may vary as described above, the specific design of connector cable 602 will vary correspondingly.

Panel coupling line 602 is adapted to be detachably coupled to port 38 of WSIU 100' by a connector 27'. Connector 27' is similar to connector 27 of FIG. 1 but it is slightly modified in several respects in accordance with the preferred embodiment. Specifically, connector 27' includes a pair of pins not used during normal WIS operations but which are grounded by the connector portion of coupling line 602. CPU 150 is modified to monitor the voltage level on these pins and to initiate test software or firmware routines when these pins are grounded during power-up of WIS 12'. Connector 27' also has pins corresponding to the pins of remote terminal address straps 133 which can be used to designate a remote terminal address for 12' as explained in detail below. Connector 27' further includes a set of pins for receiving a MIL-STD 1553 dual-redundant data bus such as bus 18 of FIG. 1.

The preferred apparatus also includes processing means mounted in WIS 12' and operatively coupled to port 38 of WSIU 100' and to a selected portion of WIS 12' to be tested, for generating a second test signal in response to the first test signal and communicating the second test signal to the selected portion of WIS 12' to cause the selected portion to communicate a response signal to the processing means corresponding to the state of the selected portion, for generating an output signal in response to and corresponding to the response signal, and for communicating the output signal to the input/output means.

The second test signal, the response signal, and the output signal will be described more fully below. Briefly, however, the second test signal comprises one or more signals or commands communicated by CPU 150 in accordance with test software or firmware routines to various selected portions of WIS 12' which are intended to cause these portions of WIS 12' to assume a desired state. The response signal comprises one or more signals communicated by the selected portions to CPU 150 which are indicative of the operational state of the selected portion, for example, the levels at buffers 540 of monitor board 408. The output signal comprises a signal communicated by CPU 150 to I/O panel 600 to drive the appropriate one of indicators 610 and 612 to indicate the results of a test.

As stated above, WIS 12' preferably includes a number of modifications relative to the WIS of FIG. 1 made in accordance with the preferred embodiment. In this regard, the processing means of this embodiment includes hardware located in WIS 12 and associated software or firmware for testing the selected portion or portions of WIS 12 in response to the first test signal applied by I/O panel 600.

The processing means preferably includes CPU 150 of WSIU 100 as described above, but modified by the addition of firmware to conduct testing of WIS 12' upon receipt of test commands (the first test signal) from panel 600. CPU 150 is preferably an 80C86 model chip manufactured by Intel Corporation of Santa Clara, Calif., and preferably includes an instruction set and sufficient memory, e.g., memory 152 of FIG. 2, to store, recall and perform at least three groups of tests—a WSIU self-test, a PSU component test, and a WIS weapon station test. CPU 150 is operatively coupled to WSIU port 38 through remote terminal board 104 as described above, and to the various selected portions of WIS 12' to be tested, as described more fully below.

The processing means of the preferred embodiment may be embodied entirely or essentially entirely in CPU 150 of WSIU 100'. The processing means may, however, be embodied in other or additional circuits and be located in a variety of positions within WIS 12'. For example, the processing means may include test circuitry incorporated into the circuit boards described above, or test circuitry located on one or more separate boards in addition to those described above.

In the presently preferred embodiment of the invention, the processing means includes test circuitry located on two system test boards in addition to CPU 150, as shown in FIG. 14. A first test board 620 is located in WSIU 100' and is used as an interface between I/O panel 600 and CPU 150. A second test board 622 is located in PSU 400' and is used to simulate the weapon system and ejector. These system test boards together with CPU 150 contain circuitry required to perform the tests noted above.

Figure 15:
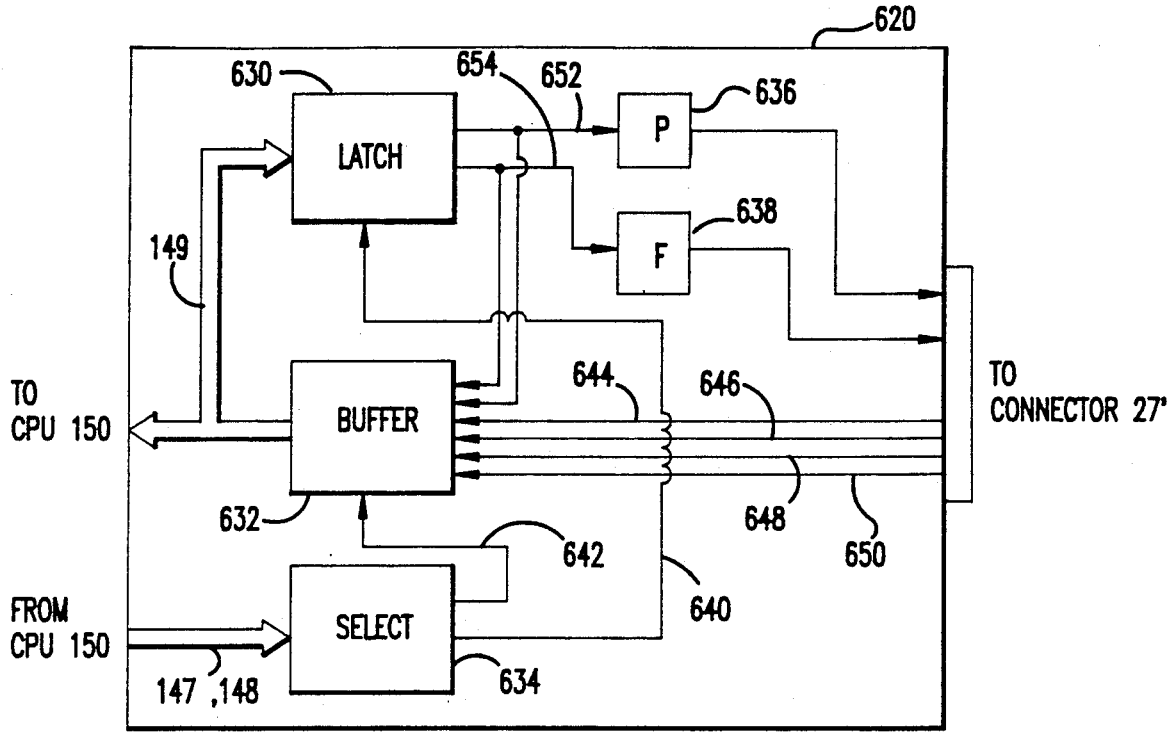
FIG. 15 is a block diagram of a system test board of the WIS evaluation apparatus as shown in FIG. 14, this test board being located in the weapon system interface unit shown in FIG. 1.

System test board 620 of WSIU 100', a block diagram of which is shown in FIG. 15, comprises input/output circuitry operatively coupled to WSIU port 38 and to CPU 150 for transforming each of the first test signal and the output signal to forms and signal levels compatible with CPU 150 and the circuitry of I/O panel 600, respectively. Test board 620 includes a latch 630, a buffer 632, a select circuit 634, and a pair of output drive buffers 636 and 638. Latch 630 and buffer 632 are coupled to CPU 150 by bus 149. Select circuit 634 is coupled to CPU 150 by buses 147 and 148, and to latch 630 and buffer 632 via select lines 640 and 642, respectively. Buffer 632 receives as an input a WSIU self-test discrete line 644 and a test start discrete line 646 from selectors 606 and 608 of I/O panel 600 via coupling line 602 and connector 27'. Buffer 632 also receives a pair of discrete input lines 648 and 650 which are grounded by connector 27' to indicate to CPU 150 that coupling line 602 is attached rather than data bus 18 and that testing is to be performed. Latch 630 has as outputs a pass indicator discrete line 652 and a fail indicator discrete line 654. Line 652 is coupled to buffers 632 and 636, and line 654 is coupled to buffers 632 and 638. Buffers 636 and 638 are adapted to selectively drive and illuminate indicators 610 and 612, respectively, of I/O panel 600 in response to an output signal on latch 630.

Figure 16:
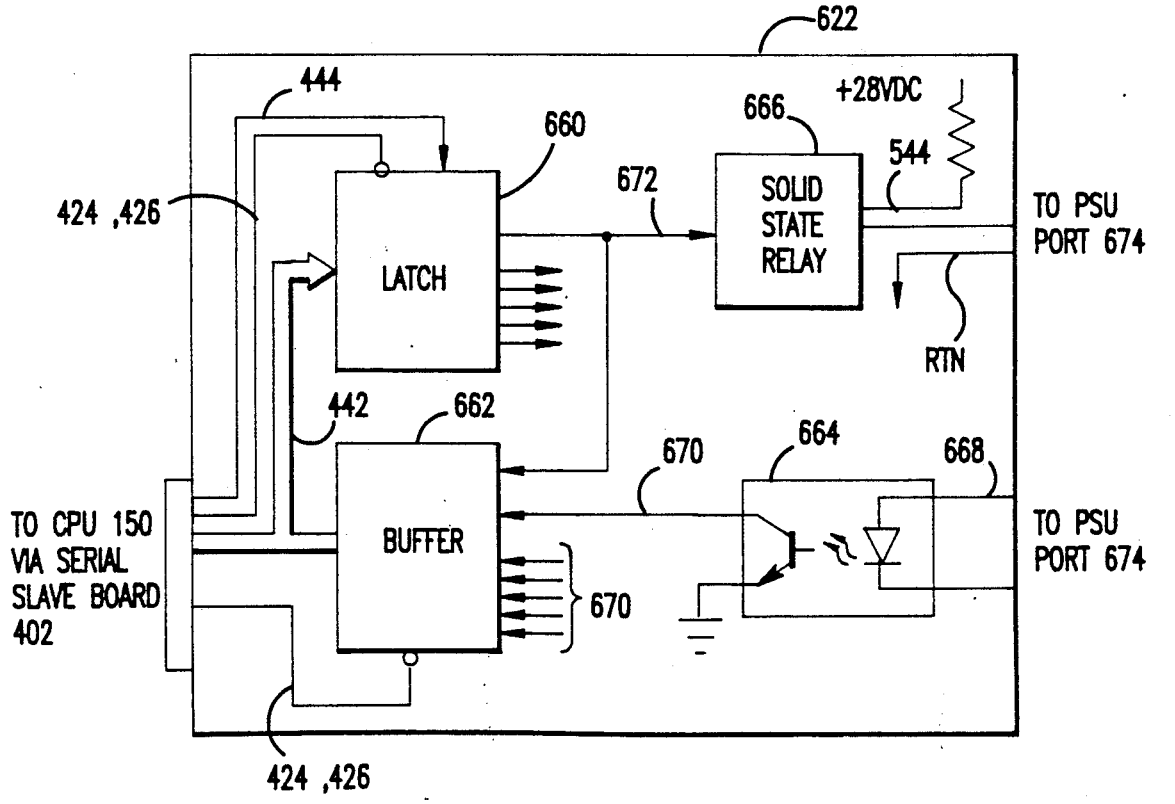
FIG. 16 is a block diagram of a system test board of an embodiment of the WIS evaluation apparatus as shown in FIG. 14, this test board being located in the power switching unit shown in FIG. 1.
Figure 17:
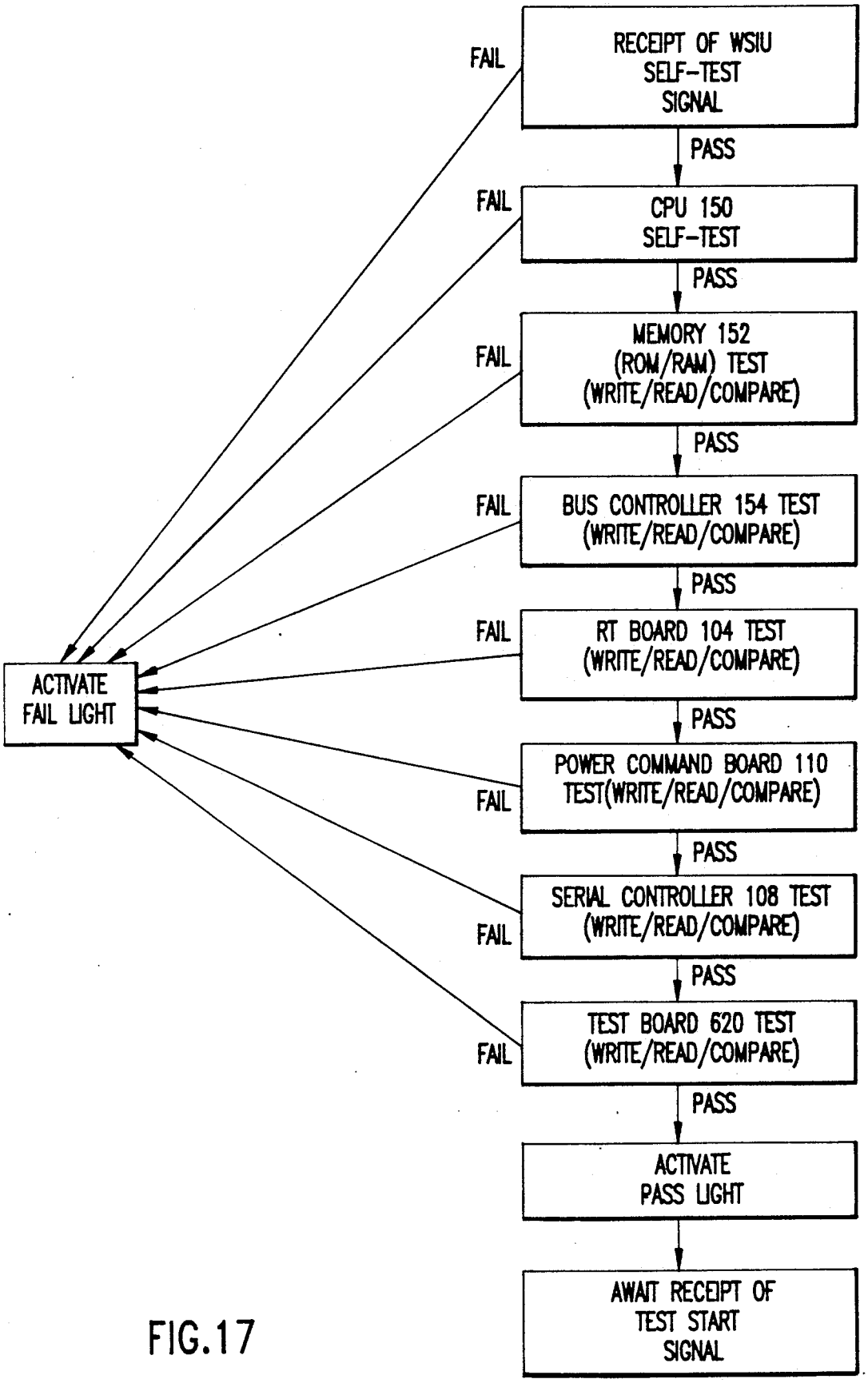
FIG. 17 is a block diagram of a WSIU self-test algorithm performed by the processing means of the preferred embodiment of the invention shown in FIG. 12.
Figure 18:
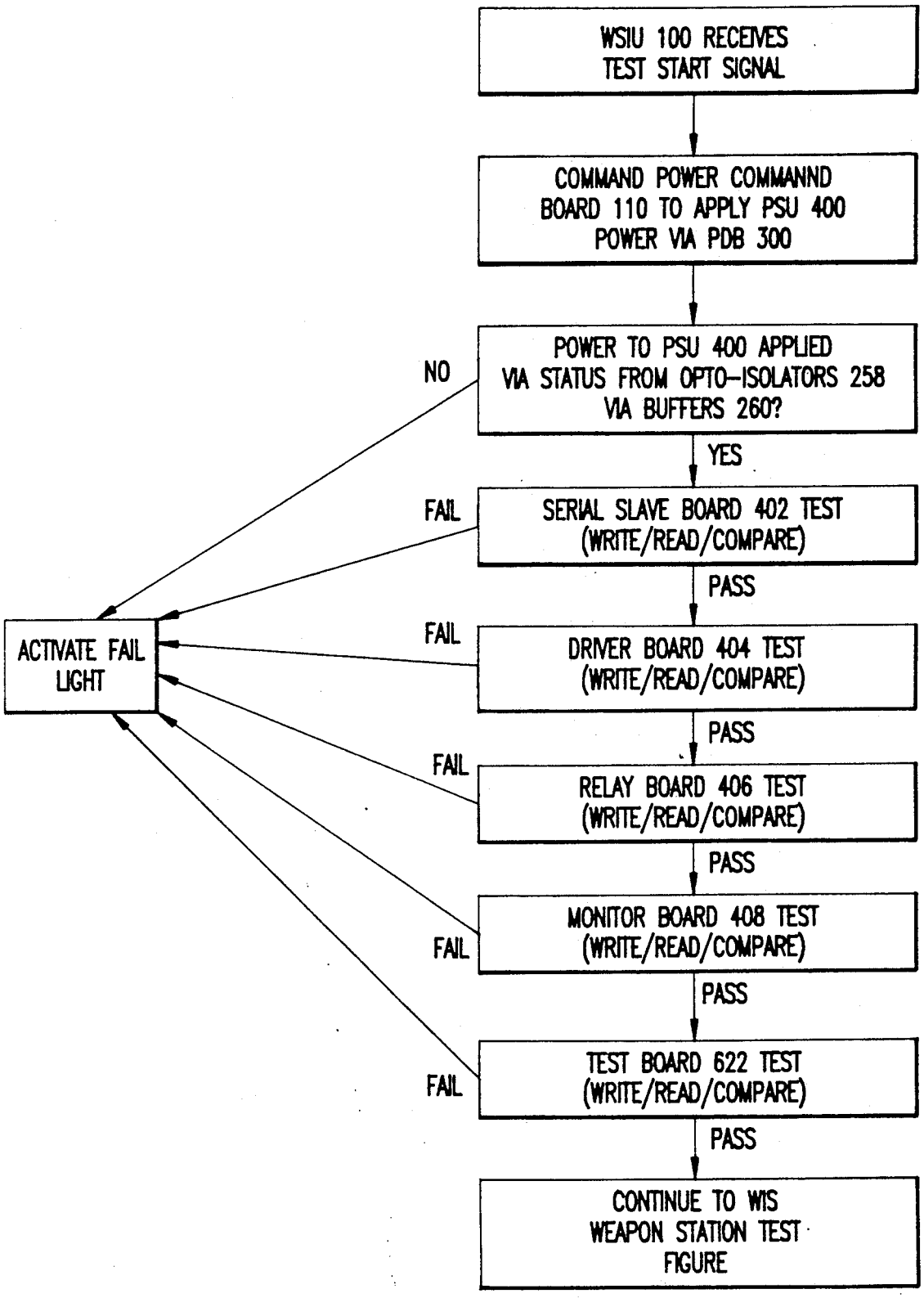
FIG. 18 is a block diagram of a PSU component test algorithm performed by the processing means of the preferred embodiment of the invention shown in FIG. 12.

A block diagram of system test board 622 of PSU 400' is shown in FIG. 16. Test board 622 includes a latch 660, a buffer 662, an opto-isolator 664, and a solid state relay 666. Latch 660 and buffer 662 are coupled to peripheral select bus 424, control bus 426, and data bus 442. Latch 660 is clocked by clock line 444. Accordingly, latch 660 and buffer 662 are adapted to communicate with CPU 150. Opto-isolator 664 is coupled at an input to a discrete line 668 such as one of the discrete lines outputted to weapon system 32 and ejector 34 from relay board 406 (FIG. 10), which causes the light emitting element of opto-isolator 664 to transmit light when line 668 is activated. The light receiving element of opto-isolator 664 is coupled to buffers 662. Discrete line 668 is coupled to PSU port 57, and is activated when a selected discrete line outputted from PSU 400', e.g., the discrete signal outputs from relay board 406, is activated. Accordingly, test board 622 preferably includes a plurality of opto-isolators such as opto-isolator 664, each receiving a selected discrete signal normally outputted from PSU 400 and provides this signal to buffer 662, as indicated by the plurality of inputs 670.

Latch 660 is coupled at its output to a discrete line 672. Line 672 is coupled to buffer 662 and solid state relay 666. Solid state relay 666 is also coupled to a 28 volt DC power source from the PSU power supply board, and to discrete line 544 which is coupled to a corresponding opto-isolator 546 of monitor board 408 (FIG. 11). The output of latch 660 on line 672 selectively switches solid state relay 666 to selectively apply 28 volts to line 554, thereby causing opto-isolator 546 and a corresponding one of buffers 540 of monitor board 408 to indicate an activated discrete to CPU 150. Latch 660 and solid state relay 666, in conjunction with CPU 150, therefore can be used to simulate the discrete signals provided by weapon system 32 and ejector 34 in an operational scenario to the monitoring circuitry of PSU 400'.

In accordance with the preferred embodiment and with reference to FIG. 14, PSU 400' includes a test port 674 to which discrete lines 544 and 668 and their corresponding return lines pass, and to which system test board 622 is coupled.

The WIS evaluation apparatus of the preferred embodiment further includes coupling means for coupling port 40 of WSIU 100' to port 38 of WSIU 100'. This enables the coupling means to receive the second test signal from WSIU port 40, e.g., a pseudo-operational command representative of a weapon system status interrogation command, and to communicate the second test signal to WSIU port 38 as the response signal.

The coupling means of the preferred embodiment is further adapted to detachably couple PSU port 57 to the simulation circuitry of system test board 622.

In accordance with the preferred embodiment, the coupling means comprises a test adapter cable 680. Cable 680 includes a dual-redundant data bus section **680*a* similar to dual-redundant data bus 18, and a remote terminal address strap section 680*b* comprising five separate discrete lines. Sections 680*a* and 680*b* are detachably coupled to WSIU port 38 at connector 27'. Data bus section 680*a* is coupled to the pins assigned in an operational configuration to dual-redundant data bus 18. The pins of connector 27 (FIG. 1) that are normally selectively grounded to designate a unique remote terminal address for the WSIU are coupled to the discrete lines of remote terminal address strap section 680*b* at connector 27'**.

Test adapter cable 680 also includes a connector **680*c* adapted to be coupled to weapon system connector 36. Connector 680*c* is thus located during testing in the position occupied by weapon system 32 in an operational configuration. Data bus section 680*a* and remote terminal address strap section 680*b* are coupled to connector 680*c*. Data bus section 680*a* is coupled to pins of connector 680*c* corresponding to the pins of connector 36 assigned to weapon system data bus 42. Remote terminal address strap section 680*b* is coupled to the pins of connector 680*c* corresponding to the pins of connector 36 assigned to remote terminal address straps 45. Accordingly, data or signals transmitted by bus controller 154 of CPU/MEM/1553 board 106 to weapon system data bus 42 via WSIU port 40 are transmitted through connector 680*c* and data bus section 680*a* of cable 680 to WSIU port 38, from which the signals are routed through remote terminal board 104 to CPU 150. Remote terminal address strap section 680*b* of cable 680 transfers the remote terminal address at remote terminal address straps 45 to remote terminal address straps 133**.

Test adapter cable 680 further includes a discrete section **680*d* comprising a plurality of discrete lines disposed in three branches. One branch 680*d*$_1$ of discrete section 680*d* is coupled to connector 680*c*. The discrete lines comprising branch 680*d*$_1$ are coupled to pins of connector 680*c* corresponding to the discrete lines of connector 36, for example, the AC weapon power discrete line, the arm solenoid discrete line, and intent to launch critical discrete line 526 from relay board 406. A second branch 680*d*$_2$ of discrete section 680*d* is coupled by a connector 680*e* to ejector connector 37 and comprises a plurality of discrete lines corresponding to the discrete lines used by ejector 34 in an operational configuration, e.g., the ejector lock discrete, ejector unlock critical discrete line 522, and squib fire critical discrete line 524 from relay board 406. A third branch 680*d*$_3$ of discrete section 680*d* is coupled via a counter 680*f* at PSU port 674 to system test board 622 and includes discrete lines corresponding to each of discrete lines 544 and 668**.

With this design, activation of selected discrete and critical discrete lines within PSU 400' such as those normally outputted to weapon system 32 and ejector 34 under operational scenarios are routed by discrete section **680*d* of test adapter cable 680 to buffer 662 of system test board 622 via opto-isolator 664. CPU 150 may then access buffer 662 via data bus 442. Similarly, discrete monitoring signals normally provided by weapon system 32 and ejector 34 to monitor board 408 can be simulated by software or firmware in CPU 150 which provides a corresponding instruction or command at latch 660, this command causing solid state relay 666 to apply power to appropriate ones of discrete lines 544 which in turn are monitored by CPU 150 via monitor board 408. Therefore, CPU 150 can simulate launch execution processing to drive discretes to weapon system 32 and ejector 34 outputted from PSU 400' at PSU port 57 essentially as described above. Each discrete outputted at PSU port 57 is coupled by a corresponding discrete line of discretes section 680*d* of cable 680 to a corresponding opto-isolator on system test board 622. Thus, CPU 150 and system test board 622 can simulate the presence of a weapon system and ejector while simultaneously providing response signals to CPU 150 indicating the operational status of the various selected components of WIS 12' required to carry out the varous operational functions performed by WIS 12** during operational launch execution processing.

It will be recalled that PSU 400' is adapted to support a plurality of weapon systems and, therefore, includes a plurality of weapon system connectors 36 and a corresponding plurality of ejector connectors 37. Test adapter cable 680 detachably couples a single weapon system connector 36 and a single ejector connector 37.

WEAPON INTERFACE SYSTEM EVALUATION METHOD

The presently preferred method of the invention, which may be carried out using the preferred embodiment described above, will now be described.

As noted above, WIS 12' is typically detached and separate from aircraft 10, weapon system 32 and ejector 34 (FIG. 1) when the test is performed. In accordance with the preferred method of the invention, an input-/output device is coupled to WSIU port 38. Preferably, this includes coupling I/O panel 600 to WSIU port 38 using coupling line 602. One of WSIU ports 40 is coupled to WSIU port 38 to cause the second test signal to be communicated from WSIU port 40 to WSIU port 38 as the response signal. With reference to FIG. 14, this preferably includes coupling data bus section 680*a* and remote terminal address strap section 680*b* of test adapter cable 680 to connector 27' at WSIU port 38, coupling connector 680*c* at a weapon system connector 36, coupling the second branch of discretes section 680*d* to a corresponding ejector connector 37, and coupling the third branch of discretes section $680d_1$ to coupler 680*f* at PSU port 674.

An external power supply 690 such as a conventional aircraft power cart is then coupled to PDB 300 to provide electrical power to WIS 12' and I/O panel 600. Upon activating external power supply 690 and supplying electrical power to WSIU 12', CPU 150 reads the status of jumpered lines 648 and 650 on buffer 632 of system test board 620. The connector of coupling line 602 at WSIU port 38 causes lines 648 and 650 to be grounded, thus indicating to CPU 150 that a test is to be performed.

After coupling I/O panel 600 and test adapter cable 680 to WIS 12', the test operator selects lamp test selector 604 to insure that the indicators on I/O panel 600 are operable. Upon successful completion of the lamp test, the test of WIS 12' is ready to begin.

Most of the circuit boards of WSIU 100' and PSU 400' include components having data storage registers or latches and buffers. Accordingly, one method to test these various components is to write an element of data to the component, to then read the contents of the component, and to compare the retrieved contents with the written data. If these elements of data are identical, the integrity of the component has been demonstrated. If the elements of data are not identical, that component has been identified as being defective. This type of test is referred below as a write/read/compare or WRC test.

Each element of data written to a component of WSIU 100' or PSU 400' constitutes a test signal, i.e., a form of the second test signal, which is communicated to a selected portion, i.e., the component to which the data is written, to cause the selected portion of WIS 12' to assume a predetermined state. This predetermined state can be communicated, e.g., read, as a response signal representative of the state of the selected portion by CPU 150. Thus, the second test signal as used herein refers to any signal communicated by the processing means intended to cause a selected portion or component within WIS 12' to assume a predetermined state. The response signal as used herein refers to any signal communicated by the selected portion or component within WIS 12' to the processing means which represents or provides information about the state of the selected portion or component.

The processing means is adapted to generate the second test signal in response to the first test signal and communicate this second test signal to each of the selected portions to cause the selected portions to communicate a response signal back to the processing means which corresponds to the operational state of each of the selected portions of WIS 12'. Although the present invention provides significant flexibility in the form of the second test signal, this signal preferably takes the form of the write portion of a plurality of WRC tests. The second test signal may also take the form of a plurality of data words communicated by bus controller 154 of CPU/MEM/1553 board 106 onto weapon system data bus 42. The second test signal still further preferably takes the form of commands issued by CPU 150 to various components of WIS 12' to selectively activate discrete and critical discrete lines to weapon system connector 36 and ejector connector 37. Each of the forms of the second test signal preferably is generated by a software or firmware routine in CPU 150.

The test operator begins testing by selecting WSIU test selector 606 on I/O panel 600 to initiate a WSIU self-test to test the operational state of various selected components of WSIU 100'. Selection of WSIU self-test selector 604 causes circuitry within I/O panel 600 to activate line 644, which causes buffer 632 to indicate to CPU 150 that a WSIU self-test is to be performed. Thus, the first test signal in this context comprises the signal on discrete line 644 and the corresponding signal at buffer 632 communicated to CPU 150 indicating that a WSIU self-test is to be performed.

Upon receiving the first test signal in the form of a WSIU SELF-TEST command, CPU 150 initiates a WSIU self-test firmware routine stored in memory 152 of CPU/MEM/1553 board 106. An example of this WSIU self-test firmware is outlined in FIG. 17. The WSIU self-test firmware preferably includes subroutines for testing selected portions or components of WSIU 100', i.e., remote terminal board components, bus controller components, serial controller components, and power switching (power command board) components. Each of the subroutines preferably includes conductin a WRC test on one or more temporary storage registers of the respective circuit boards, e.g., address buffer and latch 144 and data bus transceivers 145 of remote terminal board 104, address buffer and latch 170 and data bus transceivers 172 of bus controller 154 on CPU/MEM/1553 board 106, registers 202, 204, 206 and 208 of serial controller board 108, and latch 252 and buffers 260 of power command board 110.

As part of the WSIU self-test firmware routine, CPU 150 first conducts an internal CPU test to determine whether CPU 150 itself is operational and free of hardware or software faults. Upon passing the CPU self-test, CPU 150 systematically tests the operational status of memory 152, for example, by writing a preselected set of data to each of the memory elements comprising memory 152, by then reading these elements, and by comparing the written values with the retrieved values to verify that correct reading and writing steps have been carried out and that the integrity of the data processed in and out of memory 152 is maintained, i.e., WRC test. Upon successful completion of the memory test, a bus controller test is carried out, for example, by conducting a WRC test of registers within microprocessor interface unit 174 and bus controller interface 180. Upon successful completion of the bus controller test, a remote terminal board test is carried out, for example, by conducting a WRC test of registers within remote terminal interface 132 and microprocessor interface unit 134. This is followed by a power command board test during which, for example, power commands are communicated to latch 252 via data bus 149, and buffers 260 are read by CPU 150 via data bus 149, which is essentially a form of a WRC test. The power command board test is followed by a serial controller test in which a WRC test is carried out for input register 432 and output register 434. The serial controller test is followed by a test of system test board 620 during which, for example, CPU 150 writes data to latch 630 and then reads the status of buffer 632 in a WRC test. The result of this write/read/compare test process for the various storage registers of WSIU 100' is recorded in CPU 150. Failure of any segment of the WSIU self-test routine causes CPU 150 to load latch 630 of system test board 620 so that drive buffer 638 illuminates test fail indicator 612 via coupling line 602, thereby providing an appropriate output signal to panel 600. Upon successful completion of the system test board test, CPU 150 generates an output signal which loads latch 630 of system test board 620, thus causing drive buffer 636 to illuminate pass indicator 610 via coupling line 602.

Upon receipt of the WSIU self-test pass indication at pass indicator 610, the test operator selects test start selector 608. Circuitry in panel 600 communicates a first test signal to CPU 150 by activating discrete line 646 over coupling line 602. Discrete line 646 activates buffer 632 of system test board 620, which is accessed by CPU 150 via data bus 149. Upon receiving the test start signal, CPU 150 initiates a PSU component test firmware routine stored in memory 152, an example of which is outlined in FIG. 18. The PSU component test routine is designed to test the operational integrity of the various selected components within PSU 400', similarly to the WSIU self-test described above.

The PSU component test routine is initiated by a command from CPU 150 to latch 252 of WSIU power command board 110 causing PDB 300 to apply power to PSU 400' via power bus 56. CPU 150 monitors status of this power application by reading buffers 260 of power command board 110. Upon successful completion of power application to PSU 400', CPU 150 conducts a WRC test of input register 432, output register 434, and bus input buffer 438 of serial slave board 402. Upon successful completion of the serial slave board test, CPU 150 performs a WRC test of latches 452*a–c and status buffers 458a–c*. In addition, this driver board test may include a WRC test of the PVE circuitry, for example, by conducting a PVE sequencing routine as outlined in FIG. 9. Upon successful completion of the driver board test, or in conjunction with the driver board test, a relay board test is conducted during which relays 500, 502, 504 and 506 are selectively closed to apply power to respective ones of monitor lines 528, 530, 532 and 534. The relay board test may also include selectively closing relays 508, 510, 512, 514, 516 and 520 to selectively apply power to the various weapon system and ejector discrete and critical discrete lines. A monitor board test is also conducted as a part of the PSU component test routine to test selected components of monitor board 408. The monitor board test, which may be carried out in conjunction with the driver board and relay board tests, comprises selectively loading and then reading each of buffers 540, i.e., conducting a WRC test of buffers 540. Upon completion of the monitor board test, a system test board evaluation is conducted during which CPU 150 loads latch 660 of system test board 622 and then reads the status of buffer 662 in a WRC test.

If a fault is detected at any stage of the PSU component test routine, CPU 150 generates an output signal which loads latch 630 of system test board 620, causing drive buffer 638 to eliminate test fail indicator 612 of panel 600 via coupling line 602.

Figure 19:
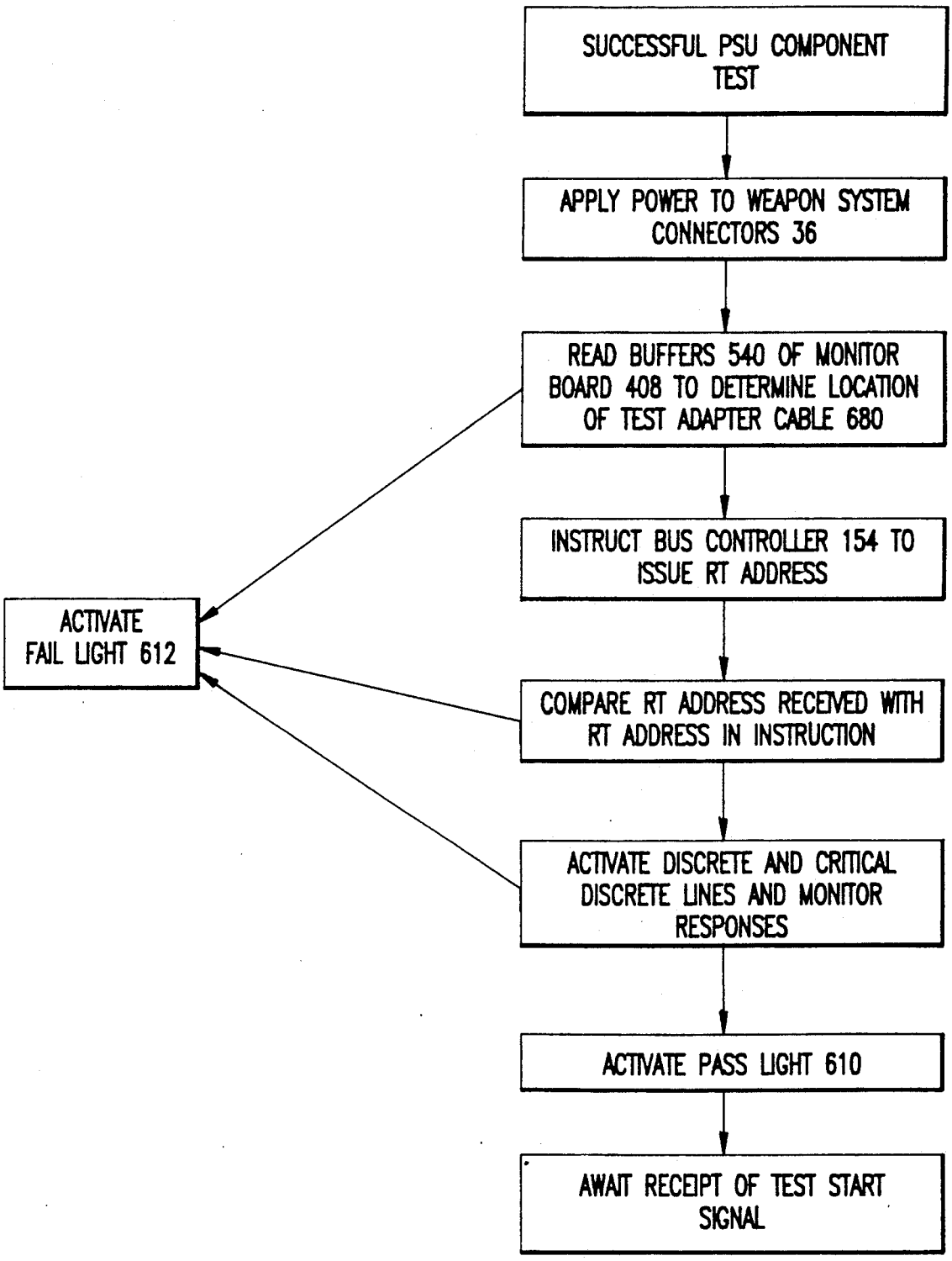
FIG. 19 is a block diagram of a WIS weapon station test algorithm performed by the processing means of the preferred embodiment of the invention shown in FIG. 12.

Upon successful completion of the PSU component test routine, CPU 150 retrieves and executes a WIS weapon station test routine, an example of which is outlined in FIG. 19. The WSIU weapon station test routine is initiated by determining to which weapon station test adapter cable 680 has been attached. To accomplish this task, CPU 150 issues commands to apply weapon system AC power to each of the weapon system connectors 36 of the various weapon stations, and monitoring buffer 662 of system test board 622 or opto-isolators 546 via buffers 540 of monitor board 408, or both. Only connector 36 of the weapon station to which test adapter cable 680 is coupled will provide a response signal to CPU 150 since the other weapon stations merely have open circuits at connector 36. By sequentially applying power to the various weapon stations, CPU 150 can determine to which weapon station test adapter cable 680 has been attached, and the remote terminal address of that weapon station.

Upon determining the weapon station under test, CPU 150 instructs bus controller 154 to issue a weapon station remote terminal address. This address is communicated via weapon system data bus 42 and coupler board 412 to weapon system connector 36. Connector 680*c* transmits the address to data bus portion 680*a*, which communicates the address back to WSIU port 38 and remote terminal board 104. Since remote terminal address strap section 680*b* of test adapter cable 680 is coupled to remote terminal address straps 45 of weapon system connector 36 at connector 680*c*, the remote terminal address of weapon system connector 36 under test is applied at remote terminal address straps 133 and remote terminal interface 132 of remote terminal board 104. This causes the address arriving at remote terminal interface 132 to be communicated to microprocessor interface unit 134. Upon being received at CPU 150, the address is compared with the address transmitted by bus controller 154. If these addresses are not identical, CPU 150 loads latch 630 of system test board 620 which causes drive buffer 638 to illuminate test fail indicator 612 of panel 600. If the addresses are identical, the WIS weapon station test routine continues to carry out the weapon station test.

The distinction between the second test signal and the response signal is less distinct for this portion of testing relative to some others. These terms, however, apply equally here as in other testing. For example, the command from CPU 150 to bus controller 154 to issue a remote terminal address comprises a form of the second test signal in which the operational status of bus controller 154, weapon system data bus 42, coupler board 412, and connector 36 are tested. A response signal in the form of the return address routed via adapter cable 680 is communicated from these components to CPU 150 via WSIU port 38.

The next portion of the WIS weapon station test routine involves activating each of the discrete lines passing through connector 36 to weapon station 32 and passing through connector 37 to ejector 34. Accordingly, CPU issues commands as described in detail above to cause each of the discrete and critical discrete lines outputted to connectors 36 and 37 from relay board 406 (FIG. 10) to be activated. CPU 150 monitors the status of each of these discrete and critical discrete lines, for example, by reading buffers 540 of monitor board 408 (FIG. 11), and by monitoring the status of buffer 662 of system test card 622. The circuitry of system test board 622 simulates the response of the weapon system and ejector that normally would be coupled to connectors 36 and 60, respectively. This simulation is accomplished by a set of instructions issued by CPU 150 to latch 660 of system test board 622 in accordance with the weapon station test routine which causes solid state relay 666 to selectively activate discrete lines 544. Discrete lines 544 and discretes section **680*d* of test adapter cable 680 communicate signals to corresponding ones of opto-isolators 546. The status of these opto-isolators are then read at buffers 540 by CPU 150. If any of the responses received by CPU 150 in accordance with the weapon station test routine fail to correspond with a predetermined set of responses corresponding to instructions provided by CPU 150, CPU 150 generates an output signal which loads latch 630 of system test board 620, thereby causing drive buffer 638 to illuminate test fail indicator 612 of panel 600. Upon receiving the appropriate responses from each of the discrete lines tested, CPU generates an output signal which causes drive buffer 636 to illuminate test pass indicator 610 of panel 600, thereby completing the weapon station test for the weapon station to which test adapter cable 680** is coupled.

The test operator then removes connectors **680*c*, 680*e* and 680*f* from connectors 36 and 37 and port 674, respectively, and couples test adapter cable 680 to a new weapon station to be tested. The test operator then selects the test start selector 608 of panel 600 to initiate testing of the new weapon station, i.e., the PSU component test and weapon station test. WIS 12' is confirmed as being in an operational state and the test of WIS 12' is terminated upon completion of testing as described above for each weapon station of WIS 12'. At this point, test adapter cable 680 is removed from WIS 12' and WIS 12' is coupled to an aircraft 10, weapon system 32, and ejector 34 in an operational configuration, as shown in FIG. 1**.

From this description, it can be seen that the advantages of the present invention are obtained in part by providing processing means within WIS 12. The active or "intelligent" components of the WIS test equipment are provided within WIS 12 itself, which is typically inherently designed to accommodate standard operational and environmental conditions. Accordingly, panel 600 can be of simple design and contain essentially passive components which are less demanding in terms of their environmental and operational constraints, while the active components of the WIS evaluation apparatus are in WIS 12 itself which is designed for this harsh environment. Furthermore, the WIS evaluation apparatus of the present invention can be operated using standard power sources typically available in a field environment, such as standard or conventional aircraft ground power carts.

Having now described the preferred embodiment, additional advantages and modifications will readily occur to those skilled in the art. Accordingly, the invention in its broader aspects is not limited to the specific details, representative apparatus and illustrative examples shown and described. Departures may be made from such details without departing from the spirit or scope of the general inventive concept as defined by the appended claims and their equivalents.

What is claimed is:

1. An apparatus for evaluating the operational status of a weapon interface system for coupling an aircraft controller to a plurality of weapon systems and a corresponding plurality of weapon ejectors, the weapon interface system having a weapon system interface unit, a power switching unit, and a power distribution box, the weapon system interface unit being coupled to the power switching unit and the power distribution box and having a first port for communicating with the aircraft controller and a second port for communicating with one of the plurality of weapon systems, the power switching unit being coupled to the weapon system interface unit and to the power distribution box and having a port for communicating with and providing power to the one of the plurality of weapn systems and a corresponding one of the plurality of ejectors, and the power distribution box being coupled to an external power supply, said apparatus comprising:

input/output means removably coupled to the first port of the weapon system interface unit for generating a first test signal and providing the first test signal to the first port of the weapon system interface unit; and processing means mounted in the weapon interface system and operatively coupled to the first port of the weapon system interface unit and to a selected portion of the weapon interface system to be tested for generating a second test signal in response to the first test signal and communicating the second test signal to said selected portion to cause said selected portion to communicate a response signal to said processing means corresponding to the state of said selected portion, and for generating an output signal in response to and corresponding to the response signal and communicating the output signal to said input/output means, said processing means including a central processing unit mounted in the weapon system interface unit and operatively coupled to the first port of the weapon system interface unit and to the selected portion of the weapon interface system to be tested, and said processing means including input/output circuit means operatively coupled to the first port of the weapon system interface unit and to said central processing unit for transforming the first test signal to a form and a signal level compatible with said central processing unit and for transforming the output signal to a form and a signal level compatible with said input/output means;

said input/output means including means responsive to the output signal for indicating the state of said selected portion.

2. An apparatus as recited in claim 1, wherein the input/output means includes an operator interface panel, said operator interface panel having at least one selector for generating the first test signal and at least one indicator for receiving the output signal from the weapon system interface unit and indicating the state of the selected portion.

3. An apparatus for evaluating the operational status of a weapon interface system for coupling an aircraft controller to a plurality of weapon systems and a corresponding plurality of weapon ejectors, the weapon interface system having a weapon system interface unit, a power switching unit, and a power distribution box, the weapon system interface unit being coupled to the power switching unit and the power distribution box and having a first port for communicating with the aircraft controller and a second port for communicating with one of the plurality of weapon systems, the power switching unit being coupled to the weapon system interface unit and to the power distribution box and having a port for communicating with and providing power to the one of the plurality of weapn systems and a corresponding one of the plurality of ejectors, and the power distribution box being coupled to an external power supply, said apparatus comprising:

input/output means removably coupled to the first port of the weapon system interface unit for generating a first test signal and providing the first test signal to the first port of the weapon system interface unit; and processing means mounted in the weapon interface system and operatively coupled to the first port of the weapon system interface unit and to a selected portion of the weapon interface system to be tested for generating a second test signal in response to the first test signal and communicating the second test signal to said selected portion to cause said selected portion to communicate a response signal to said processing means corresponding to the state of said selected portion, and for generating an output signal in response to and corresponding to the response signal and communicating the output signal to said input/output means, said processing means including a central processing unit mounted in the weapon system interface unit and operatively coupled to the first port of the weapon system interface unit and to the selected portion of the weapon interface system to be tested, and said processing means including simulation circuitry operatively coupled to said central processing unit and to said selected portion of the weapon interface system to be tested for selectively receiving the second test signal from said central processing unit and communicating said second test signal to said selected portion;

said input/output means including means responsive to the output signal for indicating the state of said selected portion.

4. An apparatus as recited in claim 3, further including coupling means for detachably coupling the port of the power switching unit to said simulation circuitry.

5. An apparatus for evaluating the operational status of a weapon interface system for coupling an aircraft controller to a plurality of weapon systems and a corresponding plurality of weapon ejectors, the weapon interface system having a weapon system interface unit, a power switching unit, and a power distribution box, the weapon system interface unit being coupled to the power switching unit and the power distribution box and having a first port for communicating with the aircraft controller and a second port for communicating with one of the plurality of weapon systems, the power switching unit being coupled to the weapon system interface unit and to the power distribution box and having a port for communicating with and providing power to the one of the plurality of weapn systems and a corresponding one of the plurality of ejectors, and the power distribution box being coupled to an external power supply, said apparatus comprising:

input/output means removably coupled to the first port of the weapon system interface unit for generating a first test signal and providing the first test signal to the first port of the weapon system interface unit; and processing means mounted in the weapon interface system and operatively coupled to the first port of the weapon system interface unit and to a selected portion of the weapon interface system to be tested for generating a second test signal in response to the first test signal and communicating the second test signal to said selected portion to cause said selected portion to communicate a response signal to said processing means corresponding to the state of said selected portion, and for generating an output signal in response to and corresponding to the response signal and communicating the output signal to said input/output means, said processing means including a central processing unit mounted in the weapon system interface unit and operatively coupled to the first port of the weapon system interface unit and to the selected portion of the weapon interface system to be tested, and said processing means including simulation circuitry operatively coupled to the contral processing unit and to the selected portion of the weapon interface system to be tested for selectively receiving the response signal from said selected portion and communicating the response signal to said central processing unit;

said input/output means including means responsive to the output signal for indicating the state of said selected portion.

6. An apparatus for evaluating the operational status of a weapon interface system for coupling an aircraft controller to a plurality of weapon systems and a corresponding plurality of weapon ejectors, the weapon interface system having a weapon system interface unit, a power switching unit, and a power distribution box, the weapon system interface unit being coupled to the power switching unit and the power distribution box and having a first port for communicating with the aircraft controller and a second port for communicating with one of the plurality of weapon systems, the power switching unit being coupled to the weapon system interface unit and to the power distribution box and having a port for communicating with and providing power to the one of the plurality of weapn systems and a corresponding one of the plurality of ejectors, and the power distribution box being coupled to an external power supply, said apparatus comprising:

input/output means removably coupled to the first port of the weapon system interface unit for generating a first test signal and providing the first test signal to the first port of the weapon system interface unit;

processing means mounted in the weapon interface system and operatively coupled to the first port of the weapon system interface unit and to a selected portion of the weapon interface system to be tested for generating a second test signal in response to the first test signal and communicating the second test signal to said selected portion to cause said selected portion to communicate a response signal to said processing means corresponding to the state of said selected portion, and for generating an output signal in response to and corresponding to the response signal and communicating the output signal to said input/output means; and coupling means for detachably coupling the second port of the weapon system interface unit to the first port of the weapon system interface unit, said coupling means receiving the second test signal from the second port of the weapon system interface unit and communicating the second test signal to the first port of the weapon system interface unit as the response signal;

said input/output means including means responsive to the output signal for indicating the state of said selected portion.

7. An apparatus as recited in claim 5, further including coupling means for detachably coupling the port of the power switching unit to said simulation circuitry.

8. A method for evaluating the operational status of a weapon interface system for coupling an aircraft controller to a plurality of weapon systems and a corresponding plurality of weapon ejectors, the weapon interface system having a weapon system interface unit, a power switching unit, and a power distribution box, the weapon system interface unit being coupled to the power switching unit and the power distribution box and having a first port for communicating with the aircraft controller and a second port for communicating with one of the plurality of weapon systems, the power switching unit being coupled to the weapon system interface unit and to the power distribution box and having a port for communicating with and providing power to the one of the plurality of weapon systems and a corresponding one of the plurality of ejectors, and the power distribution box being coupled to an external power supply, said method comprising:

coupling an input/output device to the first port of the weapon system interface unit;

generating a first test signal and providing said first test signal to the first port of the weapon system interface unit using the input/output device;

providing a processing device in the weapon interface system;

generating a second test signal using the processing device in response to said first test signal and communicating the second test signal to a selected portion of the weapon interface system to cause said selected portion to communicate a response signal to said processing device corresponding to the state of said selected portion;

coupling the second port of the weapon system interface unit to the first port of the weapon system interface unit to cause the second test signal to be communicated from the second port of the weapon system interface unit to the first port of the weapon system interface unit as a portion of the response signal;

generating an output signal using said processing device in response to and corresponding to said response signal and communicating the output signal to said input/output device; and indicating the state of said selected portion using said input/output device in response to the output signal.

* * * * *